US009214110B2

(12) United States Patent
Toyomura

(10) Patent No.: US 9,214,110 B2
(45) Date of Patent: Dec. 15, 2015

(54) DISPLAY UNIT AND ELECTRONIC APPARATUS

(71) Applicant: JOLED Inc., Tokyo (JP)

(72) Inventor: Naobumi Toyomura, Kanagawa (JP)

(73) Assignee: JOLED Inc., Tokyo (JP)

( * ) Notice: Subject to any disclaimer, the term of this patent is extended or adjusted under 35 U.S.C. 154(b) by 0 days.

(21) Appl. No.: 14/508,672

(22) Filed: Oct. 7, 2014

(65) Prior Publication Data

US 2015/0130783 A1 May 14, 2015

(30) Foreign Application Priority Data

Nov. 8, 2013 (JP) ..... 2013-232078

(51) Int. Cl.
*G09G 3/32* (2006.01)

(52) U.S. Cl.
CPC ..... *G09G 3/3266* (2013.01); *G09G 3/3258* (2013.01); *G09G 2300/0439* (2013.01)

(58) Field of Classification Search
None
See application file for complete search history.

(56) References Cited

U.S. PATENT DOCUMENTS

2009/0219234 A1* 9/2009 Yamamoto et al. ..... 345/80
2010/0141627 A1* 6/2010 Yamashita et al. ..... 345/211
2013/0057457 A1* 3/2013 Omoto ..... 345/76

FOREIGN PATENT DOCUMENTS

JP 2010-160188 7/2010

* cited by examiner

*Primary Examiner* — Gerald Johnson
*Assistant Examiner* — Christopher Kohlman
(74) *Attorney, Agent, or Firm* — Michael Best & Friedrich LLP

(57) ABSTRACT

A display unit includes a display panel and a drive circuit, the display panel including pixels, each pixel including a light emitting element and a pixel circuit, wherein the pixel circuit includes a first transistor being configured to sample a voltage of a signal line, a second transistor being configured to control a current applied to the light emitting element, a third transistor being connected to the source of the second transistor, and a holding capacitor configured to hold the voltage sampled by the first transistor, the drive circuit being configured to, when pixel rows are grouped into units, sequentially perform correction of adjusting a gate-to-source voltage of the second transistor to be close to a threshold voltage of the second transistor for each of the units, being configured to sequentially output a fixed voltage to a source of the second transistor before performing the correction.

8 Claims, 18 Drawing Sheets

DISPLAY UNIT AND ELECTRONIC APPARATUS

CROSS REFERENCE TO RELATED APPLICATIONS

This application claims the benefit of Japanese Priority Patent Application JP 2013-232078 filed Nov. 8, 2013, the entire contents of which are incorporated herein by reference.

BACKGROUND

The present technology relates to a display unit having a light emitting element in each pixel, and an electronic apparatus having the display unit.

In a field of a display unit performing image display, there has been developed and commercialized in recent years a display unit including, as a light emitting element of a pixel, a current-drive optical element that emits light of which the luminance varies depending on an applied current value, for example, an organic electro luminescence (EL) element. Unlike a liquid crystal device, etc., the organic EL element is a self-luminous light emitting element. Hence, the display unit including the organic EL element (organic EL display unit) is not necessary to have a light source (backlight), and therefore enables weight saving, thickness reduction, and high luminance compared with a liquid crystal display unit which indispensably includes a light source. Furthermore, since the organic EL element has an extremely fast response, about several microseconds, no afterimage occurs during moving image display. The organic EL display unit is therefore expected to be the mainstream of next-generation flat panel display.

As with the liquid crystal display unit, a drive type of the organic EL display unit includes a passive matrix type and an active matrix type. The passive matrix type is simple in structure, but is difficult to achieve a large and high-definition display unit. At present, therefore, the active matrix type is actively developed. In the active matrix type, a current applied to the organic EL element disposed for each pixel is controlled by a drive transistor in a pixel circuit provided for each organic EL element.

In the active-matrix organic EL display unit, scan lines are sequentially scanned, and a signal voltage Vsig corresponding to an image signal is sampled and written into a holding capacitor in each horizontal period (1H). Specifically, write operation of the signal voltage Vsig is performed through line-sequential scan in 1H cycles. In the organic EL display unit, when a threshold voltage Vth or mobility 1H of a drive transistor varies across pixels, emission luminance of the organic EL element fluctuates, and uniformity of a screen is degraded. In the active-matrix organic EL display unit, therefore, correction operation, which reduces fluctuation of emission luminance due to variation in threshold voltage Vth or mobility μ, is performed along with the line-sequential scan in 1H cycles.

In the active-matrix organic EL display unit, since power is supplied to each pixel through a power line, a large current is applied to the power line. However, since pulse power controlling emission and extinction of the organic EL element is typically applied to the power line, a power line drive circuit has an extremely large scale, and accordingly a display panel has a large bezel storing the power line drive circuit. For example, therefore, as described in Japanese Unexamined Patent Application Publication No. 2010-160188 (JP-A-2010-160188), there is proposed a pixel circuit in which a control transistor configured to control a source voltage of a drive transistor is provided while a power line is maintained to a fixed voltage.

SUMMARY

However, the pixel circuit described in JP-A-2010-160188 is necessary to have a scan driver configured to scan a control pulse controlling a source-voltage-control transistor in a vertical direction of a display region, in addition to a scan driver configured to scan a selection pulse selecting each pixel circuit in the vertical direction of the display region. Hence, a scale of a drive circuit is large, leading to high production cost.

It is desirable to provide a display unit and an electronic apparatus capable of reducing a scale of a drive circuit.

According to an embodiment of the present technology, there is provided a display unit, including a display panel, and a drive circuit configured to drive the display panel, the display panel including a plurality of pixels arranged in a matrix, each pixel including a light emitting element and a pixel circuit, a plurality of signal lines, a plurality of scan lines, one or a plurality of first power lines, a plurality of second power lines, and a plurality of control lines, wherein the pixel circuit includes a first transistor having a gate electrically connected to one of the scan lines and a source or a drain electrically connected to one of the signal lines, and being configured to sample a voltage applied to the signal line, a second transistor having a source or a drain electrically connected to one of the first power lines, and being configured to control a current applied to the light emitting element in accordance with a level of the voltage sampled by the first transistor, a third transistor having a gate, a source, and a drain, the gate of the third transistor being electrically connected to one of the control lines, one of the source and the drain of the third transistor being electrically connected to a terminal of one of the source and the drain of the second transistor, the other of the source and the drain of the third transistor being electrically connected to one of the second power lines, the terminal being unconnected to the one or one of the plurality of first power lines, and a holding capacitor configured to hold the voltage sampled by the first transistor, and wherein the drive circuit includes a signal line drive circuit configured to continuously output a first fixed voltage to each of the signal lines in a first half of one frame period, and then continuously output a signal voltage corresponding to an image signal to each of the signal lines in a second half of the one frame period, a scan line drive circuit configured to, when the plurality of scan lines are grouped into a plurality of first units, sequentially output a first selection pulse for each of the first units to perform correction of adjusting a gate-to-source voltage of the second transistor to be close to a threshold voltage of the second transistor in a first half of one frame period, and then sequentially output a second selection pulse to each of the scan lines to write the signal voltage to the gate of the second transistor in a second half of the one frame period, a control line drive circuit configured to, when the plurality of control lines are grouped into a plurality of second units having a number equal to that of the first units, sequentially output a control pulse for each of the second units to write a second fixed voltage to the terminal before performing the correction, and a power supply circuit configured to continuously output a third fixed voltage and continuously output the second fixed voltage to each of the second power lines in one frame period.

According to an embodiment of the present disclosure, there is provided an electronic apparatus including a display unit, the display unit including a display panel, and a drive circuit configured to drive the display panel, the display panel including a plurality of pixels arranged in a matrix, each pixel including a light emitting element and a pixel circuit, a plurality of signal lines, a plurality of scan lines, one or a plurality of first power lines, a plurality of second power lines, and a plurality of control lines, wherein the pixel circuit includes a first transistor having a gate electrically connected to one of the scan lines and a source or a drain electrically connected to one of the signal lines, and being configured to sample a voltage applied to the signal line, a second transistor having a source or a drain electrically connected to one of the first power lines, and being configured to control a current applied to the light emitting element in accordance with a level of the voltage sampled by the first transistor, a third transistor having a gate, a source, and a drain, the gate of the third transistor being electrically connected to one of the control lines, one of the source and the drain of the third transistor being electrically connected to a terminal of one of the source and the drain of the second transistor, the other of the source and the drain of the third transistor being electrically connected to one of the second power lines, the terminal being unconnected to the one or one of the plurality of first power lines, and a holding capacitor configured to hold the voltage sampled by the first transistor, and wherein the drive circuit includes a signal line drive circuit configured to continuously output a first fixed voltage to each of the signal lines in a first half of one frame period, and then continuously output a signal voltage corresponding to an image signal to each of the signal lines in a second half of the one frame period, a scan line drive circuit configured to, when the plurality of scan lines are grouped into a plurality of first units, sequentially output a first selection pulse for each of the first units to perform correction of adjusting a gate-to-source voltage of the second transistor to be close to a threshold voltage of the second transistor in a first half of one frame period, and then sequentially output a second selection pulse to each of the scan lines to write the signal voltage to the gate of the second transistor in a second half of the one frame period, a control line drive circuit configured to, when the plurality of control lines are grouped into a plurality of second units having a number equal to that of the first units, sequentially output a control pulse for each of the second units to write a second fixed voltage to the terminal before performing the correction, and a power supply circuit configured to continuously output a third fixed voltage and continuously output the second fixed voltage to each of the second power lines in one frame period.

In the display unit and the electronic apparatus according to the above-described respective embodiments of the present technology, the control pulse is sequentially output for each of the second units for the preparation of Vth correction. Consequently, a scale of the control line drive circuit is reduced by a degree corresponding to bundling the control lines into each unit. Furthermore, since the Vth correction is performed in the first half of one frame period, the first selection pulse is sequentially output for each of the first units. This reduces a possibility that a Vth correction period extremely varies within the second unit due to bundling the control lines into each second unit. Although it is necessary to separately provide a circuit for sequentially outputting the first selection pulse for each of the first units, a scale of such a circuit is similar to that of the control line drive circuit. Hence, the scale of the drive circuit in an embodiment of the present technology is smaller than a scale of a drive circuit having a circuit configured to perform scan for each control line. In addition, in an embodiment of the present technology, a fixed voltage is applied to each of the first power line and the second power line, while no pulse voltage is applied thereto. Hence, there is no possibility of increase in scale of a power supply circuit.

According to the display unit and the electronic apparatus of the above-described respective embodiments of the present technology, the control pulse is sequentially output for each of the second units for the preparation of Vth correction, and the first selection pulse is sequentially output for each of the first units to perform the Vth correction; hence, it is possible to reduce the scale of the drive circuit of an embodiment of the present technology.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

DETAILED DESCRIPTION

Hereinafter, an embodiment of the present technology is described in detail with reference to the accompanying drawings. It is to be noted that description is made in the following order.

1. Embodiment (display unit)
2. Modification (display unit)
3. Application examples (electronic apparatus)

1. Embodiment

Configuration

Figure 1:
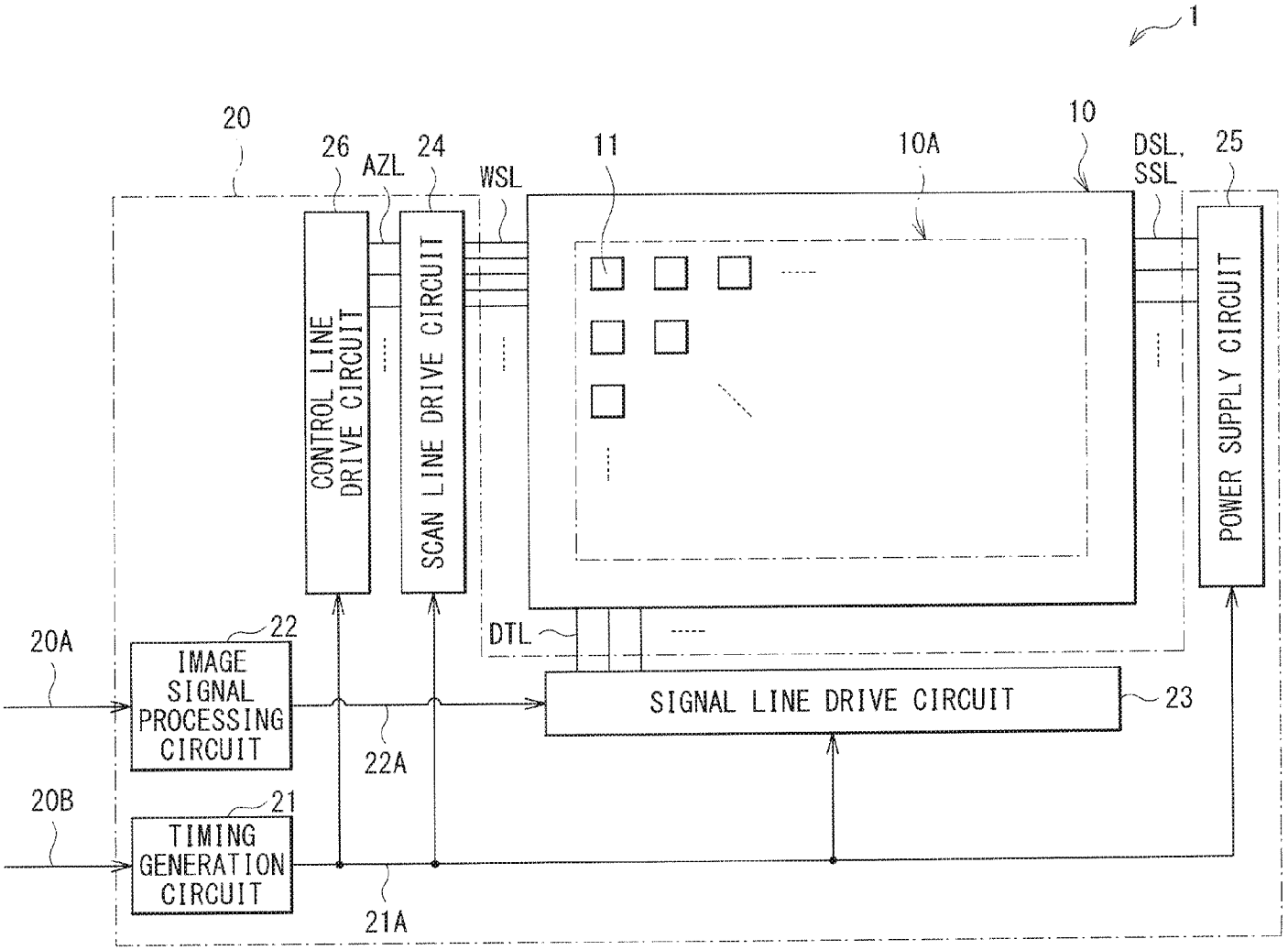
FIG. 1 is a schematic block diagram of a display unit according to one embodiment of the present technology.

FIG. 1 illustrates a schematic configuration of a display unit 1 according to one embodiment of the present technology. The display unit 1 includes a display panel 10, and a drive circuit 20 configured to drive the display panel 10 based on an image signal 20A and a synchronizing signal 20B received from outside. For example, the drive circuit 20 includes a timing generation circuit 21, an image signal processing circuit 22, a signal line drive circuit 23, a scan line drive circuit 24, a power supply circuit 25, and a control line drive circuit 26.

(Display Panel 10)

The display panel 10 includes a plurality of pixels 11 arranged in a matrix over the entire area of a display region 10A of the display panel 10. The display panel 10 displays an image based on an externally received image signal 20A through active matrix drive of each pixel 11 performed by the drive circuit 20.

Figure 2:
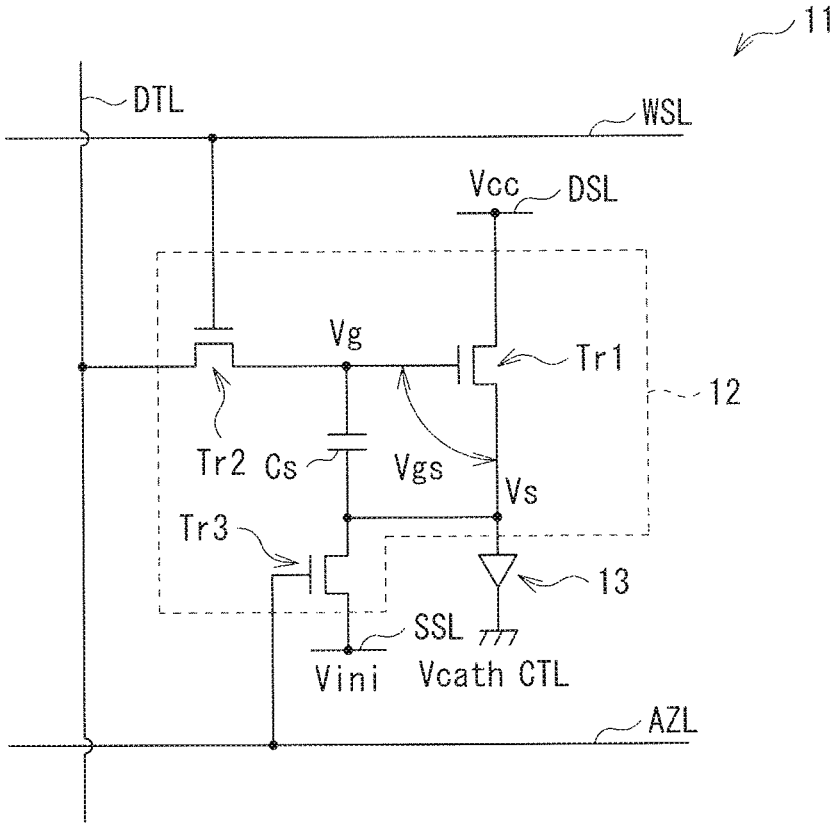
FIG. 2 is a diagram illustrating an exemplary circuit configuration of each pixel.

FIG. 2 illustrates an exemplary circuit configuration of the pixel 11. For example, the pixel 11 may include a pixel circuit 12 and an organic EL element 13. For example, the organic EL element 13 may have a configuration including an anode electrode, an organic layer, and a cathode electrode stacked in this order. The organic EL element 13 has an element capacitor. The pixel circuit 12 controls emission and extinction of the organic EL element 13. For example, the pixel circuit 12 may be configured of a drive transistor Tr1, a write transistor Tr2, a cutoff transistor Tr3, and a holding capacitor Cs, i.e., has a circuit configuration of 3Tr1C.

The write transistor Tr2 controls application, to a gate of the drive transistor Tr, of a signal voltage corresponding to an image signal. Specifically, the write transistor Tr2 samples a voltage of a signal line DTL described later, and writes the voltage to the gate of the drive transistor Tr1. The drive transistor Tr1 drives the organic EL element 13, and is connected in series to the organic EL element 13. The drive transistor Tr1 controls a current applied to the organic EL element 13 in accordance with a level of the voltage sampled by the write transistor Tr2. The cutoff transistor Tr3 performs the preparation of Vth correction described later. The holding capacitor Cs holds a predetermined voltage between the gate and the source of the drive transistor Tr1. The pixel circuit 12 may have a circuit configuration including the above-described 3Tr1C circuit and a variety of additional capacitors and transistors, or may have a circuit configuration different from the circuit configuration of 3Tr1C.

For example, the drive transistor Tr1, the write transistor Tr2, and the cutoff transistor Tr3 may each be formed of an n-channel MOS thin film transistor (TFT). Such transistors may each be formed of a p-channel MOS TFT. Although the following description is made assuming that such transistors are each of an enhancement type, such transistors may each be of a depression type. Such transistors may each be of a single-gate type or a dual-gate type.

The display panel 10 includes a plurality of scan lines WSL extending in a row direction, a plurality of signal lines DTL extending in a column direction, a plurality of power lines DSL extending in the row direction, and a plurality of power lines SSL extending in the row direction. The display panel 10 further includes a plurality of control lines AZL extending in the row direction, and a plurality of cathode lines CTL extending in the row direction. The cathode lines CTL may be configured of a common metal layer having a sheet shape. Each scan line WSL is used to select each pixel 11, and supplies, to each pixel 11, a selection pulse selecting each pixel 11 at every row. Each signal line DTL is used to supply, to each pixel 11, a signal voltage Vsig corresponding to an image signal and a fixed voltage Vofs. Each power line DSL supplies power, i.e., a fixed voltage Vcc, to each pixel 11. Each power line SSL is used for the preparation of Vth correction, and supplies a fixed voltage Vini to each pixel 11. Each control line AZL is used for the preparation of Vth correction, and supplies, to each pixel 11, a control pulse performing on/off control of the cutoff transistor Tr3. Each cathode line CTL defines a cathode voltage of the organic EL element 13, and supplies a cathode voltage Vcath to each pixel 11.

The pixel 11 is provided in the vicinity of an intersection of each signal line DTL and each scan line WSL. Each signal line DTL is connected to an undepicted output end of the signal line drive circuit 23 described later and a source or a drain of the write transistor Tr2. Each scan line WSL is connected to an undepicted output end of the scan line drive circuit 24 described later and a gate of the write transistor Tr2. Each power line DSL is connected to an undepicted output end of a power supply configured to output a fixed voltage, and a source or a drain of the drive transistor Tr1. For example, each cathode line CTL may be connected to a component provided in the periphery of the display region 10A and having a reference voltage.

The gate of the write transistor Tr2 is connected to the scan line WSL. The source or the drain of the write transistor Tr2 is connected to the signal line DTL. One terminal of the source and the drain of the write transistor Tr2, the one terminal being unconnected to the signal line DTL, is connected to the gate of the drive transistor Tr1. The source or the drain of the drive transistor Tr1 is connected to the power line DSL.

One terminal of the source and the drain of the drive transistor Tr1, the one terminal being unconnected to the power line DSL, is connected to the anode of the organic EL element 13. A first end of the holding capacitor Cs is connected to the gate of the drive transistor Tr1. A second end of the holding capacitor Cs is connected to the source (a terminal on a side close to the organic EL element 13 in FIG. 2) of the drive transistor Tr1. In other words, the holding capacitor Cs is inserted between the gate and the source of the drive transistor Tr1. The gate of the cutoff transistor Tr3 is connected to the control line AZL. The source or the drain of the cutoff transistor Tr3 is connected to the source terminal of the drive transistor Tr1. One terminal of the source and the drain of the cutoff transistor Tr3, the one terminal being unconnected to the source terminal of the drive transistor Tr1, is connected to the power line SSL.

Figure 3:
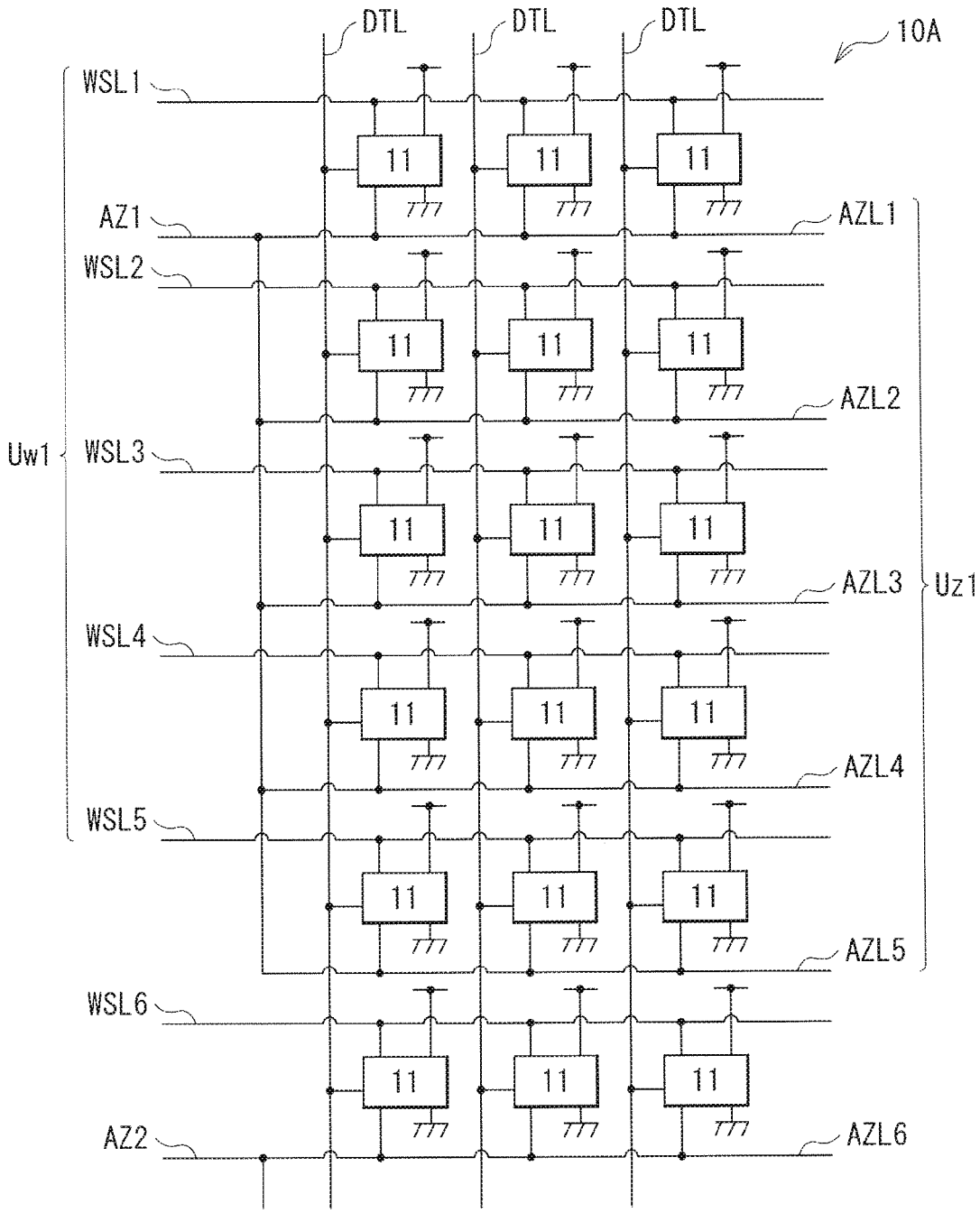
FIG. 3 is a diagram illustrating an exemplary pixel layout within a display region.

FIG. 3 illustrates an exemplary pixel layout within the display region 10A. Each scan line WSL is allocated for each pixel row. The scan lines WSL are grouped into a plurality of units Uw (Uw1 to Uwk (k is a positive integer of 2 or more). Scan lines WSL grouped into each unit Uw are subjected to "unit scan" by the scan line drive circuit 24 during the Vth correction described later. Each control line AZL is also allocated for each pixel row. The control lines AZL are grouped into a plurality of units Uz (Uz1 to Uzk (k is a positive integer of 2 or more) having the same number as that of the units Uw. Control lines AZL grouped into each unit Uz is connected to a control terminal AZ (AZ1 to AZk) allocated one for each unit Uw. The control lines AZL grouped into each unit Uz is subjected to "unit scan" by the control line drive circuit 26 during the preparation of Vth correction described later. The control terminals AZ1 to AZk may be provided in the display panel 10, or may be provided in the control line drive circuit 26 described later.

(Drive Circuit 20)

The drive circuit 20 is now described. As described above, for example, the drive circuit 20 may include the timing generation circuit 21, the image signal processing circuit 22, the signal line drive circuit 23, the scan line drive circuit 24, the power supply circuit 25, and the control line drive circuit 26. The timing generation circuit 21 controls such that the circuits in the drive circuit 20 operate in conjunction with one another. For example, the timing generation circuit 21 outputs a control signal 21A to each of the above-described circuits in response to (in synchronization with) an externally received synchronizing signal 20B.

For example, the image signal processing circuit 22 may perform predetermined correction on a digital image signal 20A received from outside, and outputs a resultant image signal 22A to the signal line drive circuit 23. For example, the predetermined correction may include gamma correction, overdrive correction, and the like.

For example, the signal line drive circuit 23 may apply, to each signal line DTL, an analog signal voltage Vsig corresponding to the image signal 22A received from the image signal processing circuit 22 in response to (in synchronization with) the received control signal 21A. For example, the signal line drive circuit 23 may be allowed to output two types of voltages (Vofs and Vsig). Specifically, the signal line drive circuit 23 supplies the two types of voltages (Vofs and Vsig) to the pixel 11 selected by the scan line drive circuit 24 through the signal line DTL. The signal voltage Vsig has a value corresponding to the image signal 20A. The fixed voltage Vofs is a constant voltage unrelated to the image signal 20A. The minimum of the signal voltage Vsig has a voltage value lower than that of the fixed voltage Vofs, while the maximum of the signal voltage Vsig has a voltage value higher than that of the fixed voltage Vofs.

The signal line drive circuit 23 continuously outputs the fixed voltage Vofs to each signal line DTL in the first half of one frame period, and then continuously outputs the signal voltage Vsig corresponding to the image signal 20A to each signal line DTL in the second half of the one frame period, as described later. The first half of one frame period means a period of one frame period before the second half of the one frame period while being not limited to the first half in the case where one frame period is divided strictly equally. Similarly, the second half of one frame period means a period of one frame period after the first half of the one frame period while being not limited to the second half in the case where one frame period is divided strictly equally.

The scan line drive circuit 24 sequentially outputs the selection pulse to each scan line WSL in a predetermined unit (for example, at every pixel row or at every unit Uw). For example, the scan line drive circuit 24 may select a plurality of scan lines WSL in a predetermined sequence in response to (in synchronization with) the received control signal 21A to allow initialization, Vth correction, writing of the signal voltage Vsig, μ correction, and light emission to be performed in desired order.

The initialization refers to initializing the gate voltage of the drive transistor Tr1 (for example, adjusting the gate voltage to Vofs). The Vth correction refers to a correction operation of adjusting the gate-to-source voltage Vgs of the drive transistor Tr1 to be close to a threshold voltage Vth of the drive transistor Tr1. The writing of the signal voltage Vsig (signal writing) refers to an operation of writing the signal voltage Vsig to the gate of the drive transistor Tr1 via the write transistor Tr2. The μ correction refers to an operation of correcting a voltage (the gate-to-source voltage Vgs) held between the gate and the source of the drive transistor Tr1 in accordance with the magnitude of mobility μ of the drive transistor Tr1. The signal writing and the μ correction may be performed at different timings. In this embodiment, the scan line drive circuit 24 outputs one selection pulse to each scan line WSL, so that the signal writing and the μ correction are performed simultaneously (or successively with no interval).

For example, the scan line drive circuit 24 may be allowed to output two types of voltages (Von1 and Voff1). Specifically, the scan line drive circuit 24 supplies the two types of voltages (Von1 and Voff1) to the pixel 11 to be driven through the scan line WSL to perform on/off control of the write transistor Tr2. The voltage Von1 has a value equal to or higher than that of the on voltage of the write transistor Tr2. The voltage Von1 is a peak value of a voltage output from the scan line drive circuit 24 in an "initialization period", a "Vth correction period", a "signal writing/μ correction period", or the like as described later. The voltage Voff1 has a value lower than the on voltage of the write transistor Tr2 and lower than the Von1. The voltage Voff1 is a peak value of a voltage output from the scan line drive circuit 24 in a "Vth correction preparation period", a "waiting period", a "light emission period", or the like as described later.

The scan line drive circuit 24 sequentially outputs the selection pulse for performing the Vth correction in the first half of one frame period. Specifically, the scan line drive circuit 24 performs "unit scan" during the Vth correction. Furthermore, the scan line drive circuit 24 sequentially outputs the selection pulse to each of the scan lines WSL in order to write the signal voltage Vsig to the gate of the write transistor Tr2 in the second half of the one frame period. Specifically, the scan line drive circuit 24 performs "line scan" during signal writing.

Figure 4:
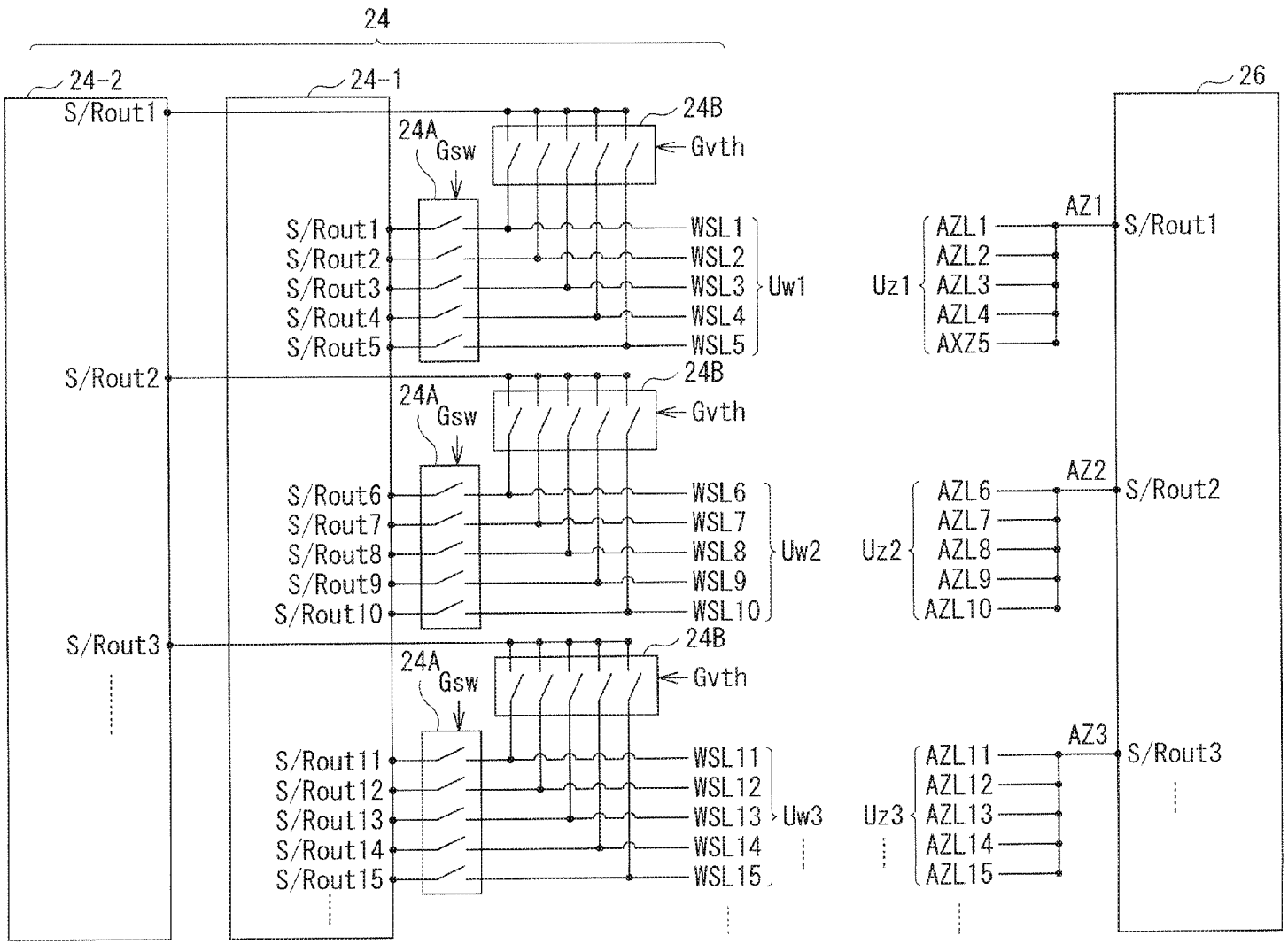
FIG. 4 is a diagram illustrating an exemplary internal configuration of a scan line drive circuit together with a control line drive circuit.

FIG. 4 illustrates an exemplary internal configuration of the scan line drive circuit 24 together with the control line drive circuit 26. It is to be noted that the scan line drive circuit 24 is not limited to the circuit illustrated in FIG. 4. The scan line drive circuit 24 may be configured of a circuit different from the circuit illustrated in FIG. 4 as long as such a circuit has a function of the circuit illustrated in FIG. 4. For example, the scan line drive circuit 24 may include a gate driver 24-1, and a plurality of switches 24A connected to output terminals S/Rout of the gate driver 24-1. Furthermore, for example, the scan line drive circuit 24 may include a gate driver 24-2, and a plurality of switches 24B connected to output terminals S/Rout of the gate driver 24-2.

The gate driver 24-1 performs "line scan". The gate driver 24-1 has the output terminals S/Rout (S/Rout1 to S/Routm (m is a positive integer)) having the same number as that of the scan lines WSL. Each switch 24A has internal switches having the same number as that of the scan lines WSL included in one unit Uw. In each switch 24A, the respective input terminals of the internal switches are connected to the respective output terminals S/Rout of the gate driver 24-1, and the respective output terminals of the internal switches are connected to the respective scan lines WSL. The respective output terminals S/Rout of the gate driver 24-1 are connected to the respective scan lines WSL via the respective switches 24A. The drive circuit 20 controls connection/disconnection between each output terminal S/Rout of the gate driver 24-1 and each scan line WSL through input of a control signal Gsw to each switch 24A.

The gate driver 24-2 performs "unit scan". The gate driver 24-2 has the output terminals S/Rout (S/Rout1 to S/Routk (k is a positive integer)) having the same number as that of the units Uw. Each switch 24B has internal switches having the same number as that of the scan lines WSL included in one unit Uw. In each switch 24B, all input terminals of the internal switches are connected to one output terminal S/Rout of the gate driver 24-2, and the respective output terminals of the internal switches are connected to the respective scan lines WSL. The respective output terminals S/Rout of the gate driver 24-2 are connected to the respective scan lines WSL via the respective switches 24B. The drive circuit 20 controls connection/disconnection between each output terminal S/Rout of the gate driver 24-2 and each scan line WSL through input of a control signal Gvth to each switch 24B.

Each scan line WSL included in the unit Uw is connected to the output terminal S/Rout of the gate driver 24-1 via the switch 24A, and is connected to the output terminal S/Rout of the gate driver 24-2 via the switch 24B. When the write transistor Tr2 is on, the drive circuit 20 connects the output terminal S/Rout of one of the gate drivers 24-1 and 24-2 to the scan lines WSL. Specifically, when the write transistor Tr2 is on, the drive circuit 20 outputs the control signals Gsw and Cvth, which each allow one of the switches 24A and 24B to be on, to the switches 24A and 24B, respectively.

The power supply circuit 25 outputs a constant voltage to each power line DSL. In one frame period, the power supply circuit 25 continuously outputs a constant voltage (the fixed voltage Vcc) to each power line DSL, and continuously outputs a constant voltage (the fixed voltage Vini) to each power line SSL. The fixed voltages Vcc and Vini are each a constant voltage unrelated to the image signal 20A. The fixed voltage Vcc has a voltage value equal to or higher than a value of a voltage (Vel+Vcath) as the sum of the threshold voltage Vel of the organic EL element 13 and the cathode voltage Vcath of the organic EL element 13. The fixed voltage Vini has a voltage value equal to or lower than a value of (Vofs−Vth).

The control line drive circuit 26 sequentially outputs a control pulse for each of the units Uz (Uz1 to Uzk) for the preparation of Vth correction. Specifically, the control line drive circuit 26 sequentially outputs the control pulse for each of the control terminals AZ (AZ1 to AZk) for the preparation of Vth correction. For example, the control line drive circuit 26 may sequentially select a plurality of control terminals AZ in response to (in synchronization with) the received control signal 21A, and thereby allows the preparation of Vth correction to be performed. The output terminals S/Rout (S/Rout1 to S/Routk (k is a positive integer)) of the control line drive circuit 26 are connected to the control terminals AZ different from one another. Herein, the "preparation of Vth correction" refers to setting of the source voltage Vs of the drive transistor Tr1 to a voltage value (the fixed voltage Vini) allowing start of the Vth correction at the beginning of the Vth correction.

For example, the control line drive circuit 26 may be allowed to output two types of voltages (Von2 and Voff2). Specifically, the control line drive circuit 26 supplies the two types of voltages (Von2 and Voff2) to the pixel 11 to be driven through the control line AZL to perform on/off control of the write transistor Tr2. The voltage Von2 has a value equal to or higher than that of the on voltage of the cutoff transistor Tr3. The voltage Von2 corresponds to a peak value of a voltage output from the control line drive circuit 26 in the "preparation of Vth correction period" as described later. The voltage Voff2 has a value lower than the on voltage of the cutoff transistor Tr3 and lower than the Von2. The voltage Voff2 corresponds to a peak value of a voltage output from the control line drive circuit 26 in any of periods other than the "Vth correction preparation period".

[Operation]

Operation of the display unit 1 of this embodiment (operation from extinction to emission) is now described. In this embodiment, there is included a compensation operation for variation in I-V characteristics of the organic EL element 13 in order to maintain emission luminance of the organic EL element 13 to be constant without being affected by temporal variation of the I-V characteristics of the organic EL element 13 even if such temporal variation occurs. In this embodiment, there is further included a compensation operation for variation in threshold voltage or mobility of the drive transistor Tr1 in order to maintain emission luminance of the organic EL element 13 to be constant without being affected by temporal variation of the threshold voltage or the mobility of the drive transistor Tr1 even if such temporal variation occurs.

Figure 5:
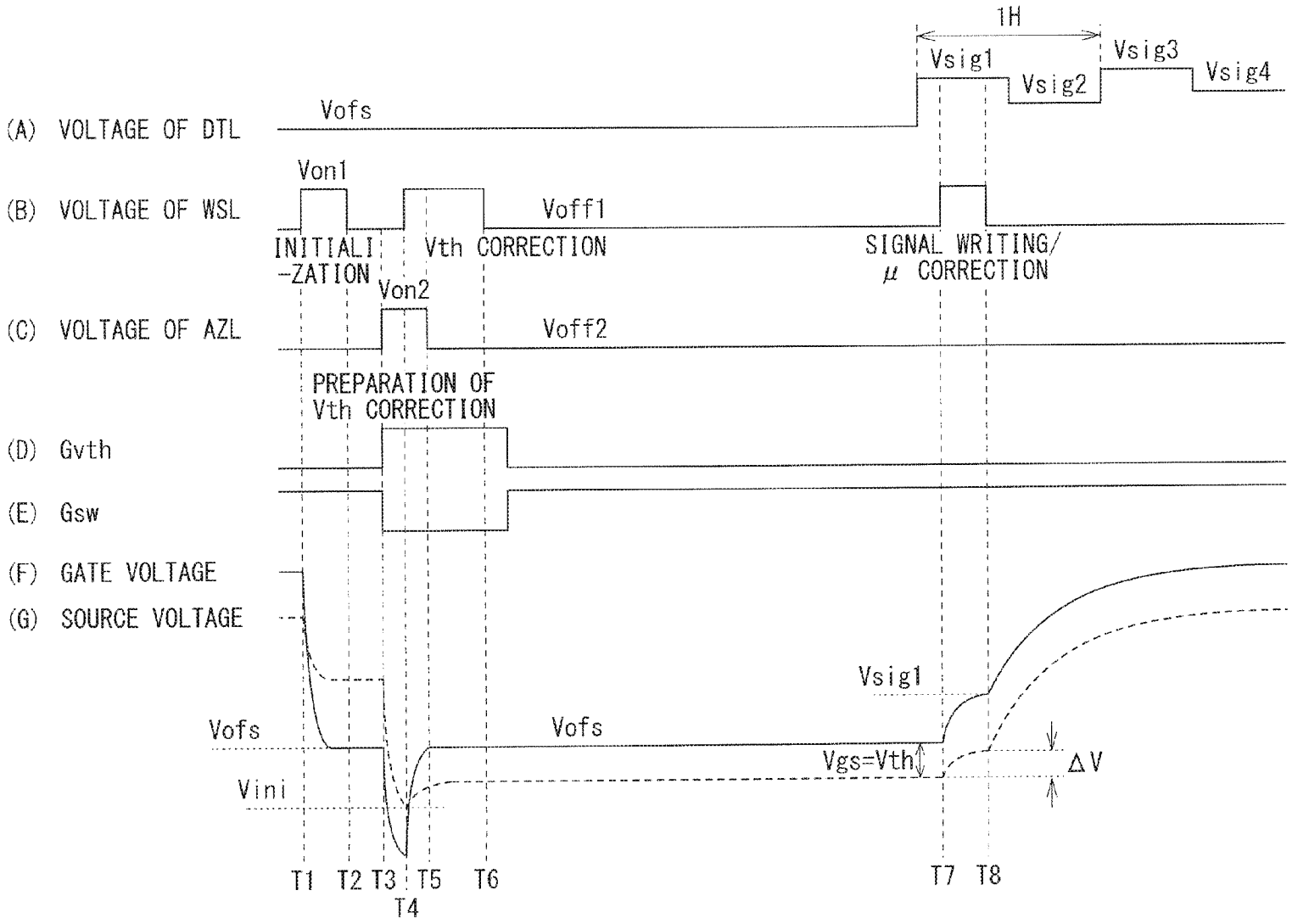
FIG. 5 is a waveform diagram illustrating an exemplary temporal variation of a voltage output to each of DTL, WSL, and AZL, and an exemplary temporal variation of each of a gate voltage and a source voltage when one pixel is focused.

FIG. 5 illustrates, when one pixel 11 is focused, an exemplary temporal variation of a voltage applied to each of the signal line DTL, the scan line WSL, the control line AZL, and the switches 24A and 24B, and an exemplary temporal variation of each of the gate voltage and the source voltage of the drive transistor Tr1.

(Initialization Period)

First, the drive circuit 20 performs initialization of the gate voltage of the drive transistor Tr1. Specifically, when the scan line WSL has a voltage of Voff1, and when the signal line DTL has a voltage of Vofs, the scan line drive circuit 24 raises a voltage being output to the scan line WSL from Voff1 to Von1 in response to the control signal 21A (time T1). In other words, while the organic EL element 13 emits light, the scan line drive circuit 24 raises the voltage being output to the scan line WSL from Voff1 to Von1 in response to the control signal 21A. The voltage Vofs is thereby supplied to the gate of the drive transistor Tr1; hence, the drive transistor Tr1 is turned off. Such turning off of the drive transistor Tr1 suspends application of a current Ids to the organic EL element 13, and therefore the organic EL element 13 is changed into a non-light-emitting state.

(Preparation of Vth Correction)

Subsequently, the drive circuit 20 prepares the Vth correction. Specifically, first, the scan line drive circuit 24 lowers the voltage being output to the scan line WSL from Von1 to Voff1 in response to the control signal 21A (time T2). Subsequently, the control line drive circuit 26 raises the voltage being output to the control line AZL from Voff2 to Von2 in response to the control signal 21A (time T3). The cutoff transistor Tr3 is thereby turned on, and the fixed voltage Vini is supplied to the source of the drive transistor Tr1. Consequently, the source voltage Vs becomes equal to the fixed voltage Vini, and the gate voltage Vg is also changed to a voltage lower than the fixed voltage Vini through coupling via the holding capacitor Cs.

The gate-to-source voltage Vgs of the drive transistor Tr1 is −Vth (=Vofs−(Vofs+Vth)). In other words, the gate-to-source voltage Vgs of the drive transistor Tr1 is smaller than the threshold voltage Vth of the drive transistor Tr1, i.e., corresponds to a cutoff operating point. Specifically, even if the drain voltage of the drive transistor Tr1 is a voltage Vcc that allows the organic EL element 13 to emit light, no current is applied to the drive transistor Tr1, and initialization of the gate voltage of the drive transistor Tr1 is maintained. As a result, the source voltage Vs becomes equal to the fixed voltage Vini.

(Vth Correction Period)

Subsequently, the drive circuit 20 performs the Vth correction. Specifically, while each signal line DTL has a voltage of Vofs, and while each control line AZL has a voltage of Von2, the scan line drive circuit 24 raises a voltage output to the scan line WSL from Voff1 to Von1 in response to the control signal 21A (time T4). The gate-to-source voltage Vgs of the drive transistor Tr1 thereby temporarily becomes larger than the threshold voltage Vth. Consequently, the drive transistor Tr1 is turned on, and current application to the drive transistor Tr1 is started. Subsequently, the source voltage Vs rises, and the holding capacitor Cs is charged to Vth, and accordingly the gate-to-source voltage Vgs becomes equal to Vth. As a result, the Vth correction is completed.

(Waiting Period)

Subsequently, the drive circuit 20 waits until signal writing and μ correction are started. Specifically, the control line drive circuit 26 lowers the voltage being output to the control line AZL from Von2 to Voff2 in response to the control signal 21A (time T5), and the scan line drive circuit 24 lowers the voltage of each scan line WSL from Von1 to Voff1 in response to the control signal 21A (time T6). In addition, the signal line drive circuit 23 changes the voltage being output to the signal line DTL from Vofs to Vsig (for example, Vsig1) at the end of the waiting period.

(Signal Writing and μ Correction Period)

Subsequently, the drive circuit 20 performs writing of a signal voltage corresponding to the image signal 20A, and the μ correction. Specifically, while the voltage of the signal line DTL is Vsig (for example, Vsig1), the scan line drive circuit 24 raises the voltage being output to the scan line WSL from Voff1 to Von1 in response to the control signal 21A (time T7). The gate of the drive transistor Tr1 is thereby connected to the signal line DTL, and the gate voltage Vg becomes equal to the voltage Vsig (for example, Vsig1). In this stage, the source voltage Vs is still lower than the threshold voltage Vel of the organic EL element 13, and the organic EL element 13 is in cutoff. The current Ids is therefore applied to the element capacitor of the organic EL element 13, and the element capacitor is charged. As a result, the source voltage Vs rises by ΔV, and eventually the gate-to-source voltage Vgs becomes equal to Vsig+Vth−ΔV. In this way, the μ correction is performed concurrently with writing. Since ΔV increases with increase in mobility μ of the drive transistor Tr1, reducing the gate-to-source voltage Vgs by ΔV before light emission makes it possible to remove variation in mobility μ across the pixels 11.

(Light Emission Period)

Finally, the drive circuit 20 performs light emission operation. Specifically, the scan line drive circuit 24 lowers the voltage being output to the scan line WSL from Von1 to Voff1 in response to the control signal 21A (time T8). The current Ids thereby flows between the drain and the source of the drive transistor Tr1, and the source voltage Vs rises. As a result, a voltage equal to or higher than the threshold voltage Vel is applied to the organic EL element 13, and the organic EL element 13 emits light at a desired luminance.

Figure 6:
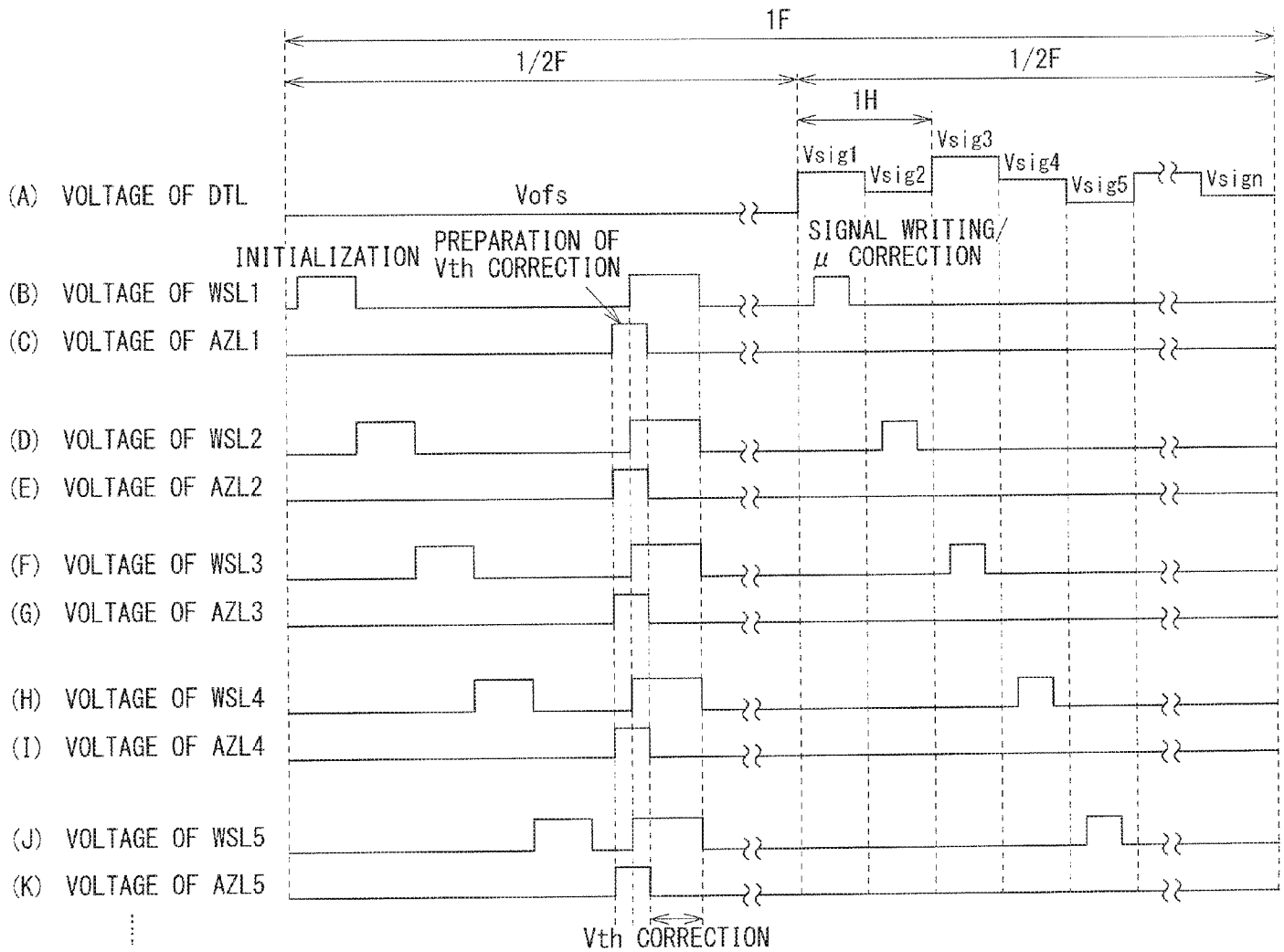
FIG. 6 is a waveform diagram illustrating an exemplary temporal variation of a voltage output to each of DTL, WSL1 to WSL5, and AZL1 to AZL5 when five pixel rows are focused.

FIG. 6 illustrates an exemplary temporal variation of a voltage applied to each of DTL, WSL1 to WSL5, and AZL1 to AZL5 in a first frame period.

In this embodiment, as described above, the signal line drive circuit 23 continuously outputs the fixed voltage Vofs to each signal line DTL in the first half of one frame period, and then continuously outputs the signal voltage Vsig corresponding to the image signal 20A to each signal line DTL in the second half of the one frame period. Furthermore, in the first half of one frame period, the drive circuit 20 sequentially performs initialization of all pixel rows at every pixel row, and sequentially performs the preparation of Vth correction and the Vth correction of all pixel rows for each of the units Uw. The drive circuit 20 sequentially performs signal writing to all pixel rows at every pixel row in the second half of the one frame period.

In "line scan" during initialization, the drive circuit 20 outputs the control signals Gvth and Gsw, which allow the switch 24A to be on and the switch 24B to be off, to the control line drive circuit 26 (see FIG. 5). In "unit scan" during the preparation of Vth correction and the Vth correction, the drive circuit 20 outputs the control signals Gvth and Gsw, which allow the switch 24A to be off and the switch 24B to be on, to the control line drive circuit 26 (see FIG. 5).

For example, the scan line drive circuit 24 may simultaneously output the selection pulse to all the scan lines WSL in the unit Uw in order to perform the Vth correction. The selection pulse during the Vth correction may not be simultaneously supplied to all the pixels 11 in the unit Uw due to, for example, manufacturing error or parasitic capacitance of the scan line WSL. Moreover, for example, the control line drive circuit 26 may simultaneously output the selection pulse to all the control lines AZL in the unit Uw in order to perform the preparation of Vth correction. The selection pulse for the preparation of Vth correction may not be simultaneously supplied to all the pixels 11 in the unit Uw due to, for example, manufacturing error or parasitic capacitance of the control line AZL.

[Effects]

Effects of the display unit 1 of this embodiment are now described.

Figure 14:
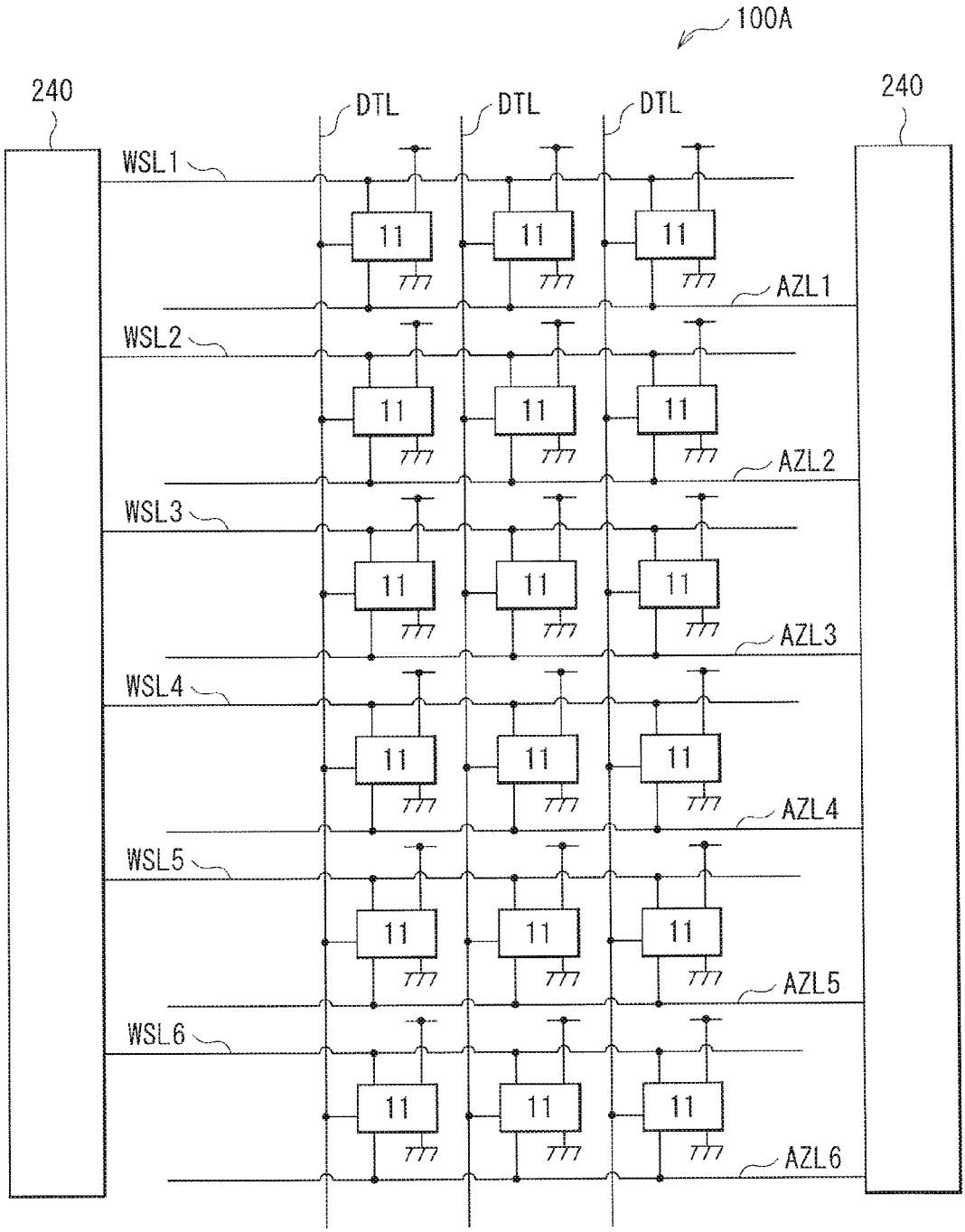
FIG. 14 is a diagram illustrating an exemplary pixel layout within a display region in a comparative example.
Figure 15:
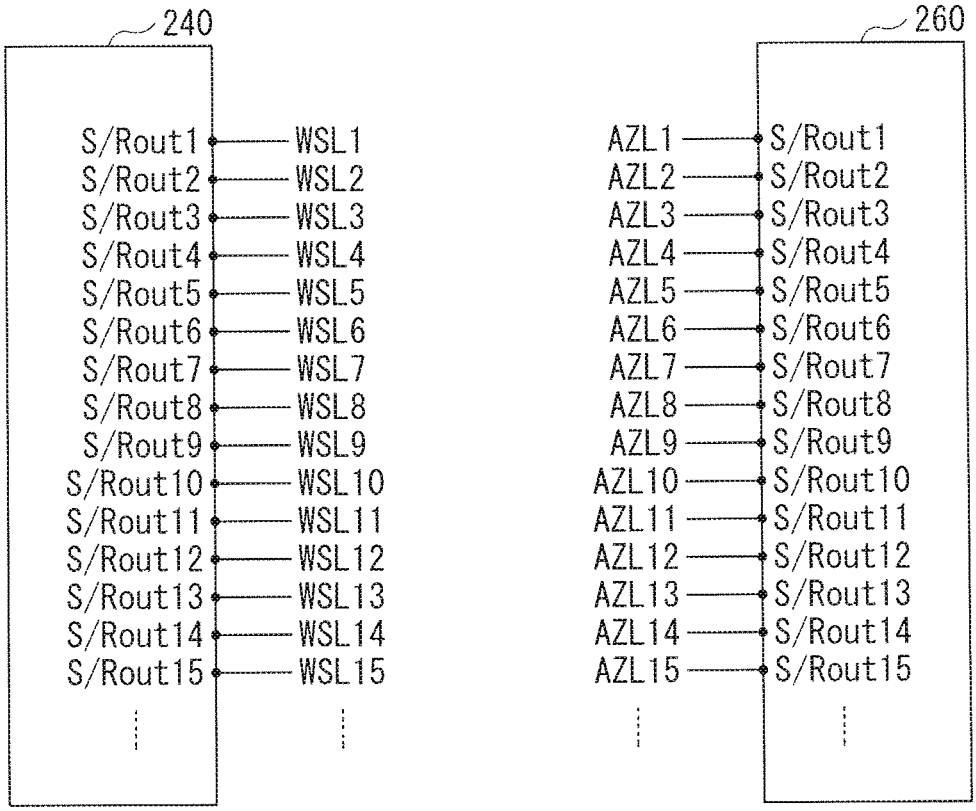
FIG. 15 is a diagram illustrating an exemplary terminal configuration of each of a scan line drive circuit and a control line drive circuit in the comparative example.

In the active-matrix organic EL display unit, since power is supplied to each pixel through a power line, a large current is applied to the power line. However, pulse power, which controls emission and extinction of the organic EL element, is typically applied to the power line. Hence, a scale of a power line drive circuit is extremely large, and a display panel also has a large bezel storing the power line drive circuit. For example, therefore, it is considered that a control transistor configured to control a source voltage of a drive transistor is provided while each power line is maintained to a fixed voltage (see JP-A-2010-160188). However, in such a case, for example, as illustrated in FIGS. 14 and 15, necessary scan drivers are not satisfied only by providing a scan driver 240 that sequentially outputs a selection pulse selecting each pixel circuit to each of scan lines WSL (WSL1 to WSLm (m is an positive integer)). Specifically, it is further necessary to provide a scan driver 260 configured to sequentially output a control pulse that controls a source-voltage-control transistor to each of control lines AZL (AZL1 to AZLm) in a display region 100A. A scale of a drive circuit therefore becomes large, leading to high production cost.

Figure 16:
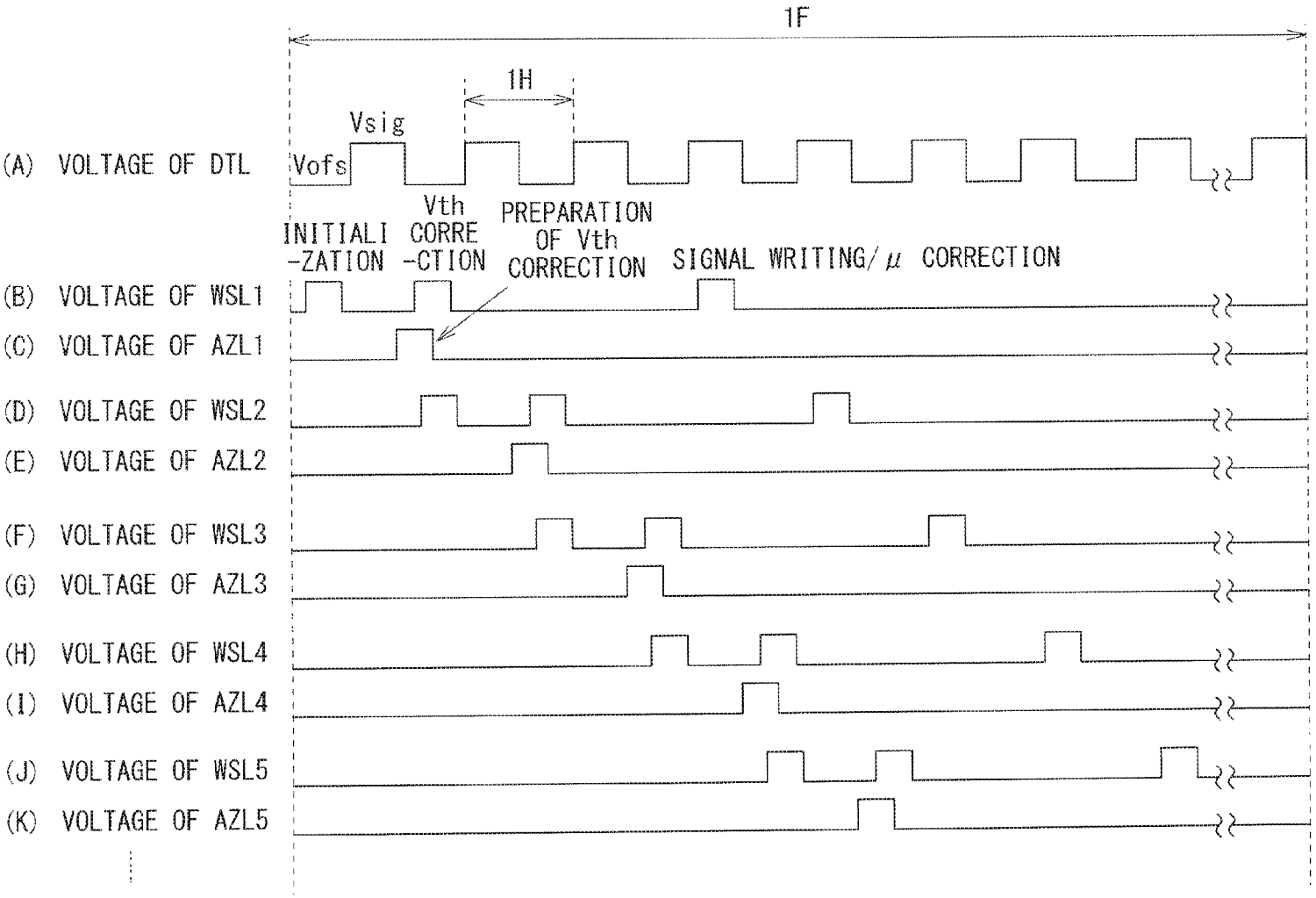
FIG. 16 is a waveform diagram illustrating an exemplary temporal variation of a voltage output to each of DTL, WSL1 to WSL5, and AZL1 to AZL5 in the pixel layout of FIG. 14 and the terminal configuration of FIG. 15.

In addition, time of 1H is increasingly decreased along with recent increase in resolution. Hence, for example, as illustrated in FIG. 16, when the initialization, the preparation of Vth correction, the Vth correction, and the signal writing/μ correction are performed while the signal voltage Vsig and the fixed voltage Vofs are alternately applied to each signal line, a timing margin may be short due to wiring transient. In this case, uniformity may be degraded.

Figure 17:
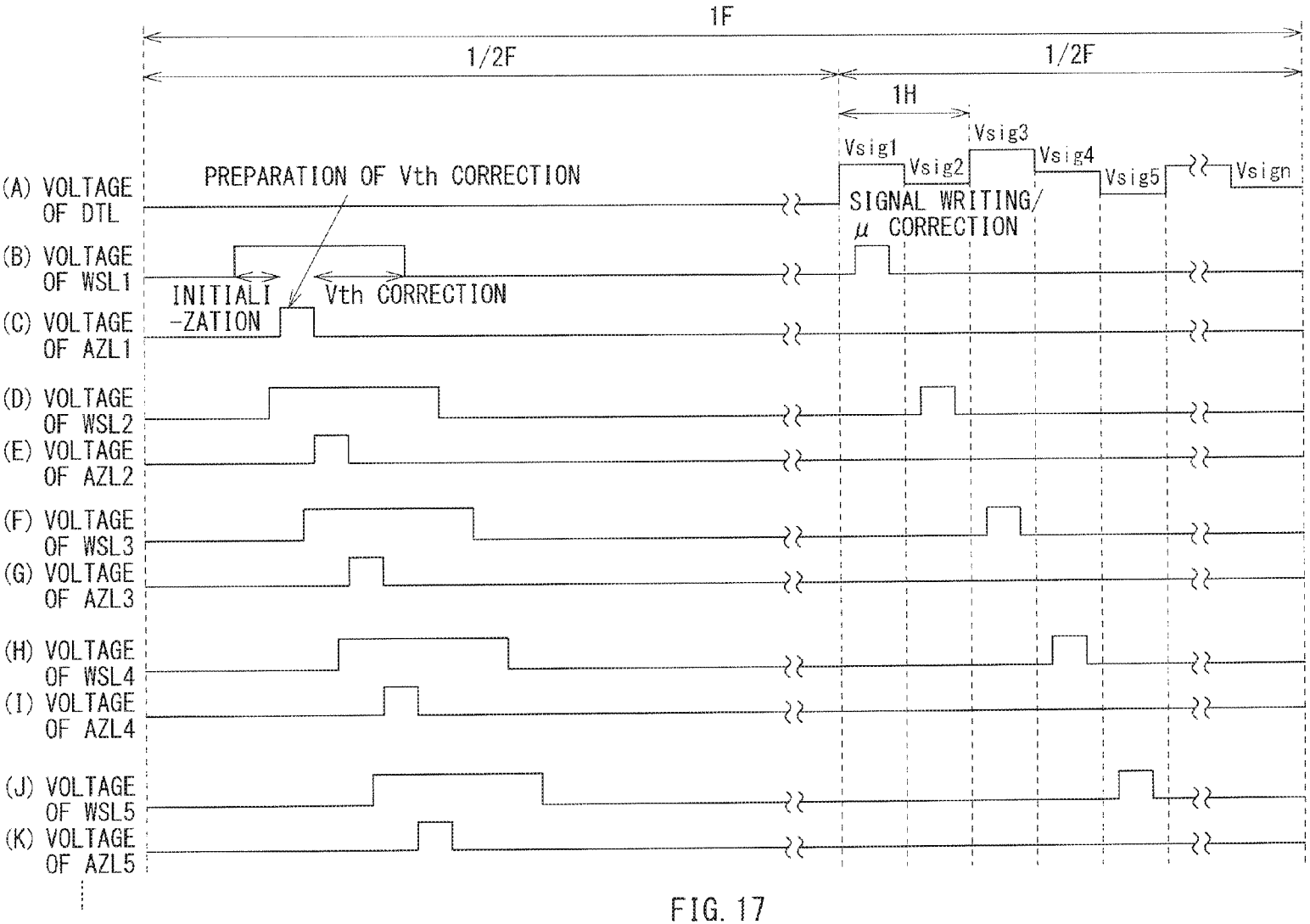
FIG. 17 is a waveform diagram illustrating an exemplary temporal variation of a voltage output to each of DTL, WSL1 to WSL5, and AZL1 to AZL5 in the pixel layout of FIG. 14 and the terminal configuration of FIG. 15.

For example, therefore, as illustrated in FIG. 17, it is considered that the fixed voltage Vofs is continuously output to each signal line DTL in the first half of one frame period, and then the signal voltage Vsig corresponding to the image signal 20A is continuously output to each signal line DTL in the second half of the one frame period. At this time, it is possible that the initialization, the preparation of Vth correction, and the Vth correction are sequentially performed at every pixel row in the first half of one frame period, and then the signal writing/μ correction is sequentially performed at every pixel row in the second half of the one frame period. Consequently, since the initialization, the preparation of Vth correction, and the Vth correction are not limited within 1H, it is possible to secure a sufficient timing margin for each of such corrections. Even in such a case, however, the scale of the drive circuit is not effectively reduced.

Figure 18:
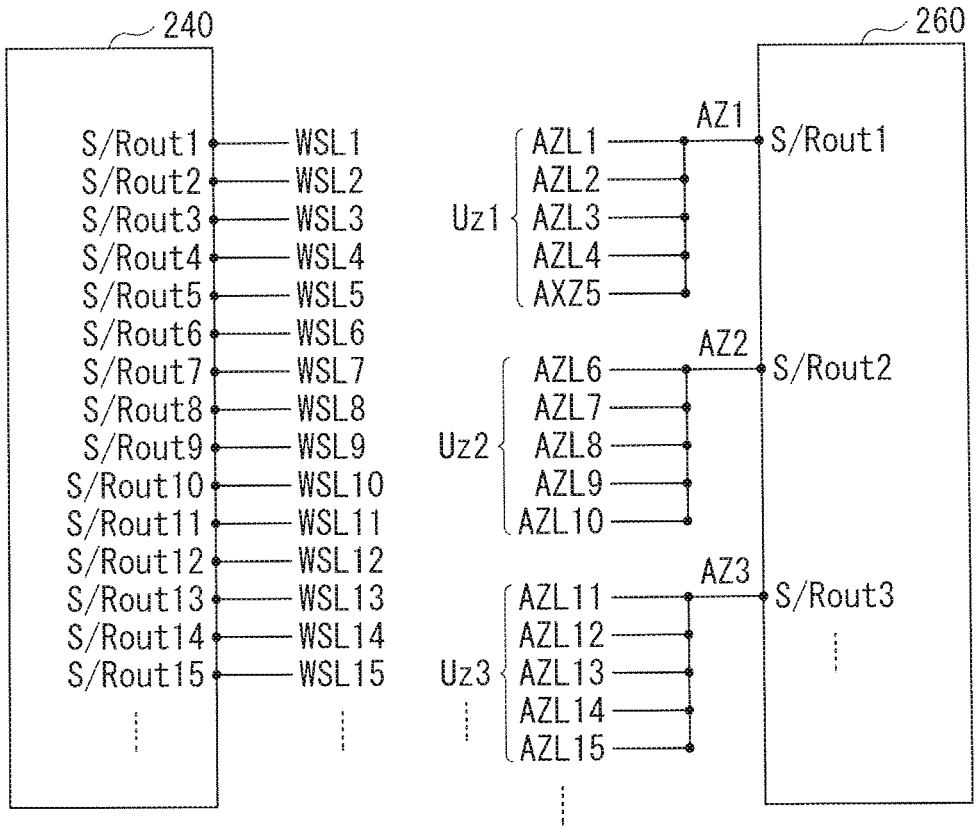
FIG. 18 is a diagram illustrating an exemplary terminal configuration of each of a scan line drive circuit and a control line drive circuit in a comparative example.
Figure 19:
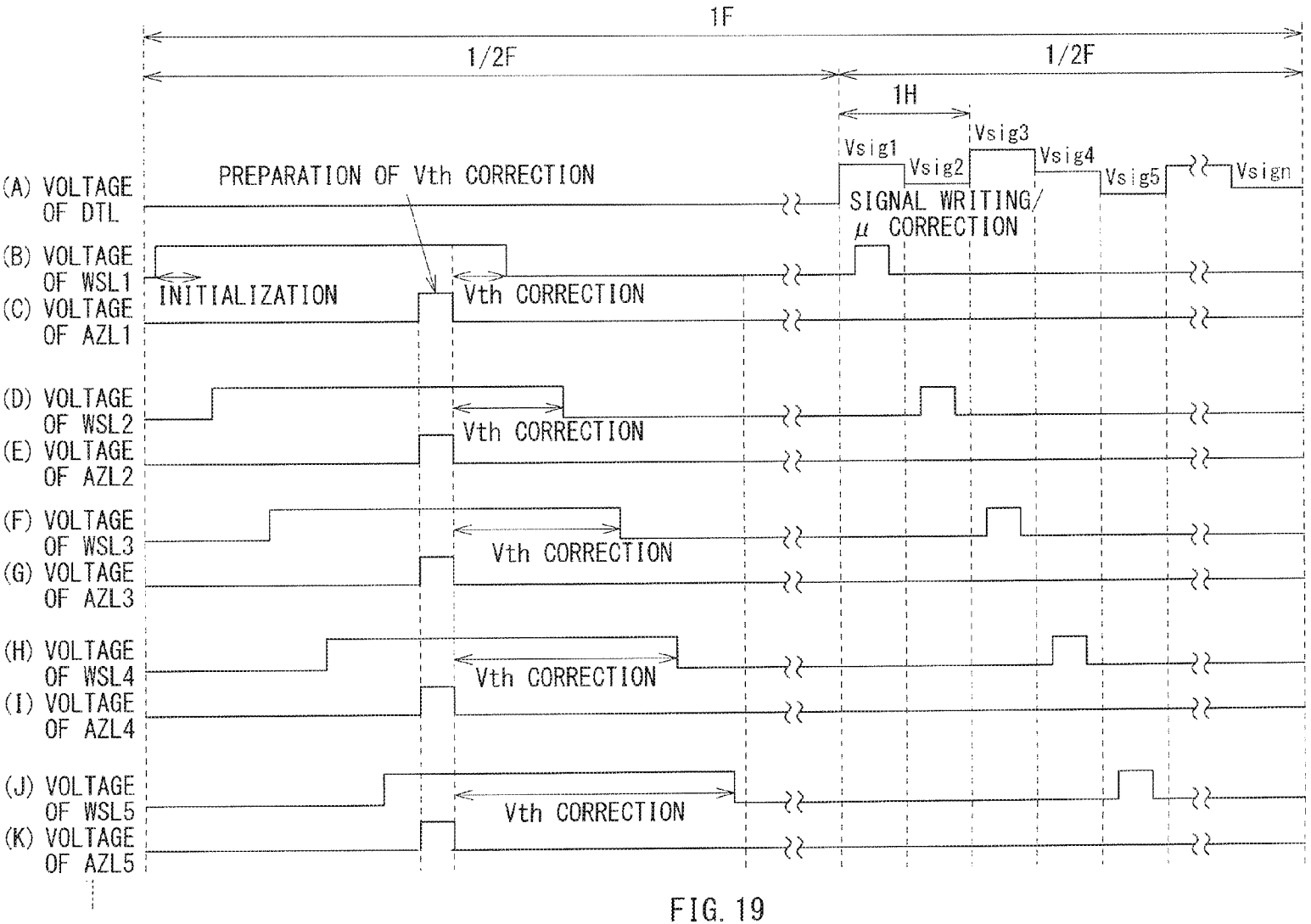
FIG. 19 is a waveform diagram illustrating an exemplary temporal variation of a voltage output to each of DTL, WSL1 to WSL5, and AZL1 to AZL5 in the pixel layout of FIG. 14 and the terminal configuration of FIG. 18.

For example, therefore, as illustrated in FIG. 18, it is considered that a plurality of control lines AZL are grouped into a plurality of units Uz to decrease the number of output terminals S/Rout of the scan driver 260. In such a case, for example, as illustrated in FIG. 19, the preparation of Vth correction is allowed to be sequentially performed for each of the units Uz in the first half of one frame period. It is therefore possible to reduce a circuit scale of the scan driver 260 by a degree corresponding to bundling the control lines AZL into each unit Uz.

In such a case, however, Vth correction periods at the pixel rows in the unit Uz are different from one another. Specifically, the Vth correction period is shorter at an upper stage in the unit Uz, while being longer at a lower stage in the unit Uz. In other words, the gate-to-source voltage Vgs is relatively large and emission luminance is high at an upper stage in the unit Uz, but the gate-to-source voltage Vgs is relatively small and emission luminance is low at a lower stage in the unit Uz. As a result, shading occurs in the unit Uz, and a boundary between the units Uz is viewed as a streak.

In contrast, in this embodiment, since the Vth correction is performed in the first half of one frame period, the selection pulse is sequentially output for each of the units Uw. This makes it possible to reduce a possibility that the Vth correction periods are extremely different from one another in the unit Uz due to bundling the control lines AZL into each unit Uz. Although it is necessary to provide a circuit (the gate driver 24-2) for sequentially outputting the selection pulse for each of the units Uw, a scale of such a circuit is similar to that of the control line drive circuit 26. Hence, the scale of the drive circuit 20 is allowed to be smaller than a scale of a circuit (for example, the above-described scan driver 260) having a circuit configured to perform scan for each of the control lines AZL. Moreover, in this embodiment, the fixed voltage Vcc or Vini is applied to each of the power lines DSL and SSL, while no pulse voltage is applied thereto. Hence, there is no possibility of increase in scale of the power supply circuit 25. Consequently, in this embodiment, a scale of the drive circuit 20 is allowed to be further reduced.

2. Modification

A modification of the display unit 1 according to the above-describe embodiment is now described. In the following description, components common to those of the display unit 1 according to the above-described embodiment are designated by the same numerals. Furthermore, description on the components common to those of the display unit 1 according to the above-described embodiment is appropriately omitted.

Figure 7:
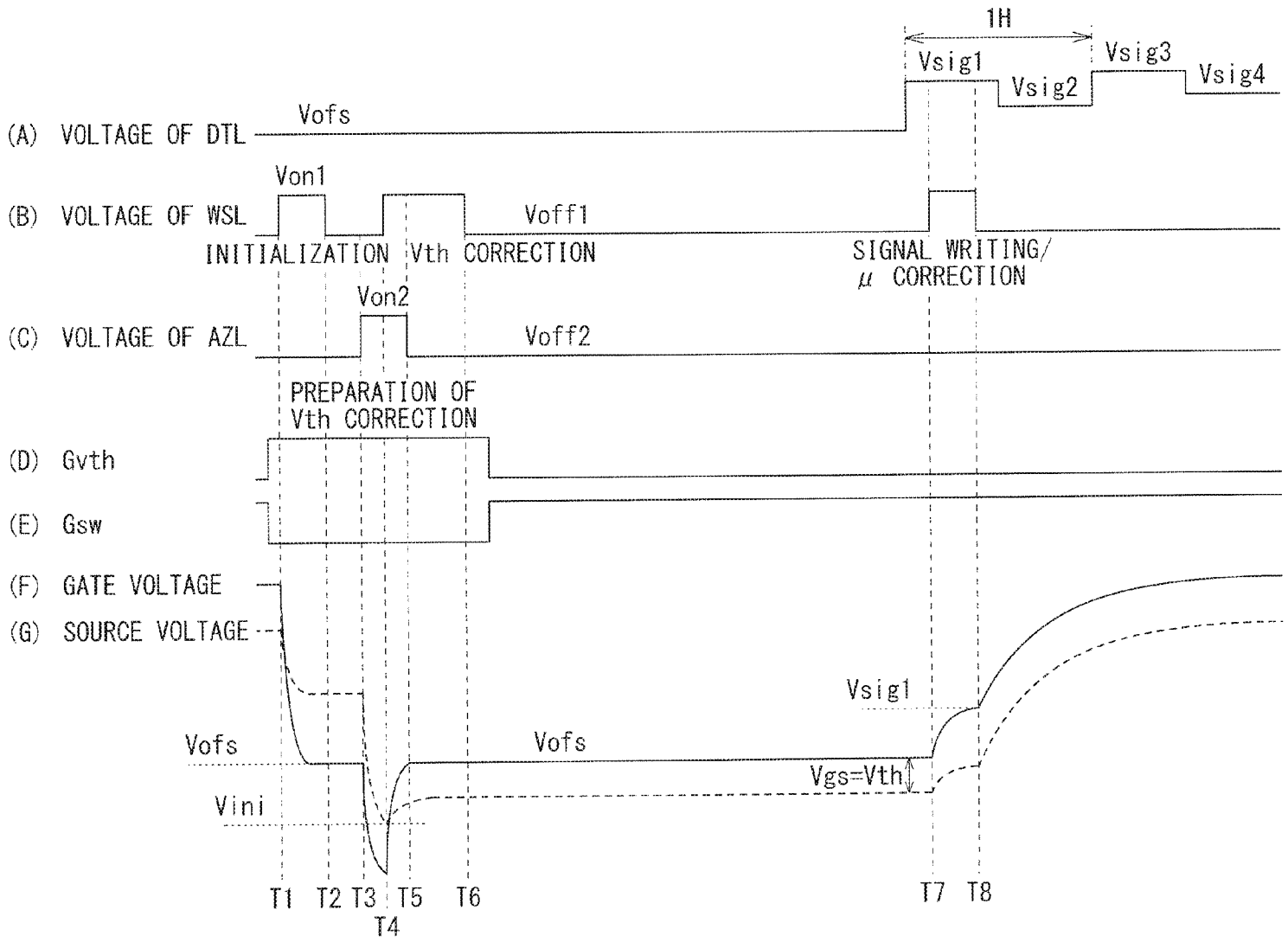
FIG. 7 is a waveform diagram illustrating an exemplary temporal variation of a voltage output to each of DTL, WSL, and AZL, and an exemplary temporal variation of each of a gate voltage and a source voltage when one pixel is focused.
Figure 8:
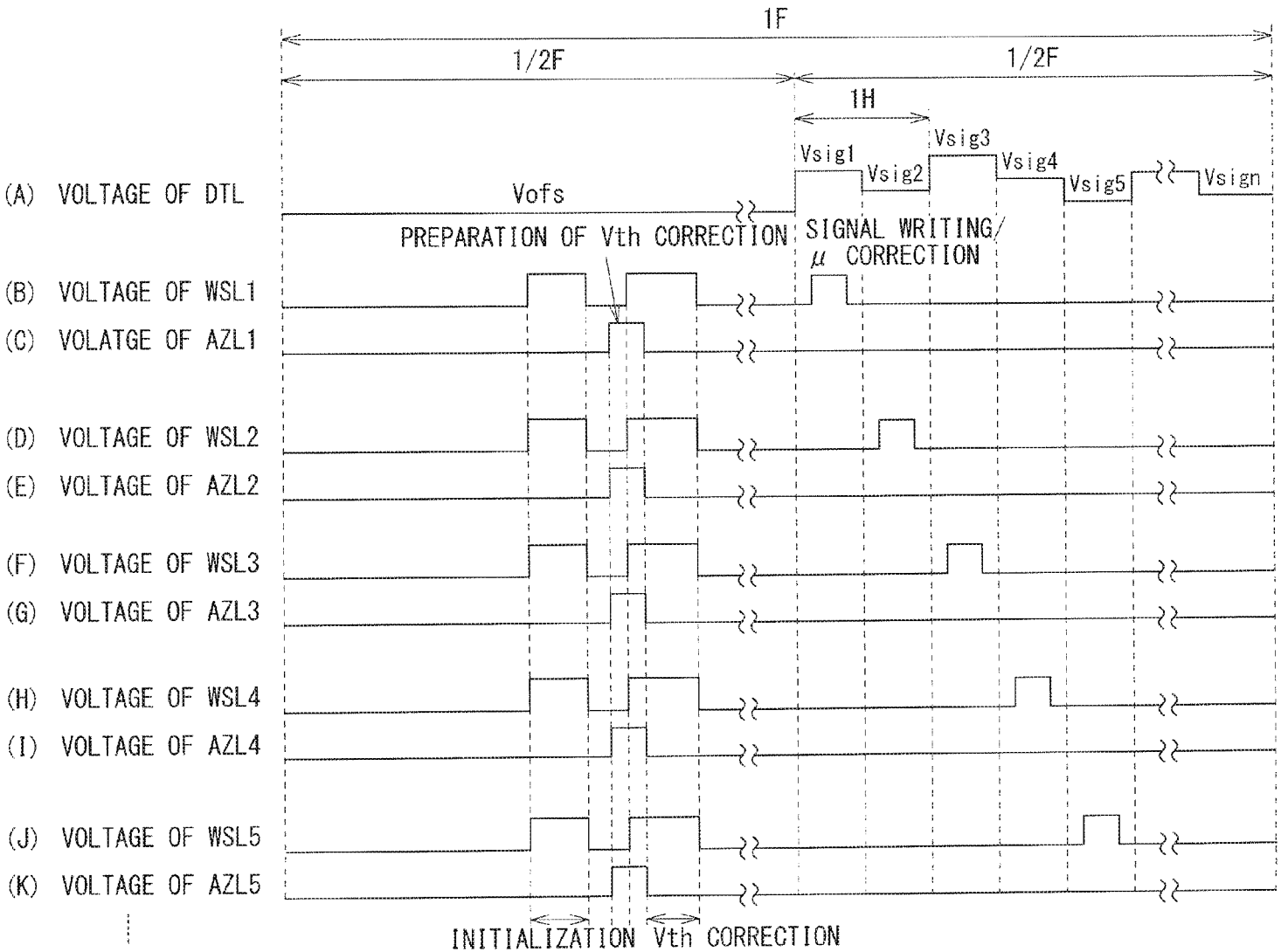
FIG. 8 is a waveform diagram illustrating an exemplary temporal variation of a voltage output to each of DTL, WSL1 to WSL5, and AZL1 to AZL5 when five pixel rows are focused.

In the above-described embodiment, the drive circuit 20 sequentially performs the initialization at every pixel row. However, for example, as illustrated in FIG. 7, the drive circuit 20 may output the control signals Gvth and Gsw, which allows the switch 24A to be off and the switch 24B to be on, to the control line drive circuit 26 during the initialization. In such a case, for example, as illustrated in FIG. 8, the drive circuit 20 is allowed to sequentially perform the initialization for each of the units Uw. In such a case, effects similar to those in the above-described embodiment are also allowed to be obtained.

3. Application Examples

Application examples of any of the display unit 1 described in the above-described embodiment and its modification (hereinafter, referred to as "the above-described embodiment, etc.") are now described. The display unit 1 of the above-described embodiment is applicable to electronic apparatuses in various fields for displaying externally-received or internally-generated image signals as still or video images. Examples of the electronic apparatuses may include a television unit, a digital camera, a notebook personal computer, a mobile terminal device such as a mobile phone, a video camcorder, and the like.

Application Example 1

Figure 9:
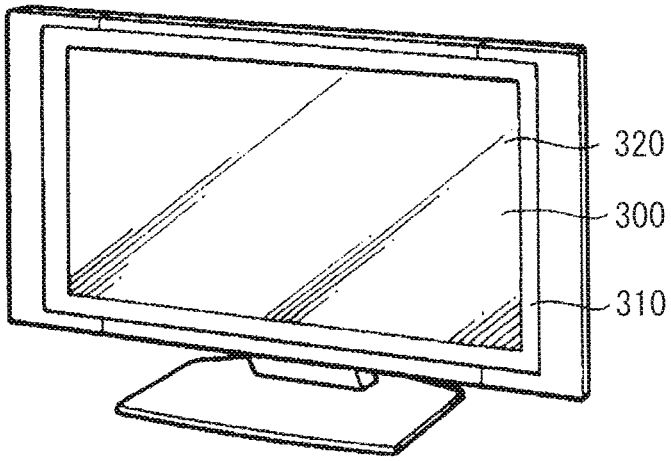
FIG. 9 is a perspective diagram illustrating appearance of application example 1 of the display unit of the above-described embodiment.

FIG. 9 illustrates appearance of a television unit to which the display unit 1 of the above-described embodiment, etc. is applied. The television unit may have, for example, an image display screen section 300 including a front panel 310 and filter glass 320. The image display screen section 300 is configured of the display unit 1 according to the above-described embodiment and its modification.

Application Example 2

Figure 10A:
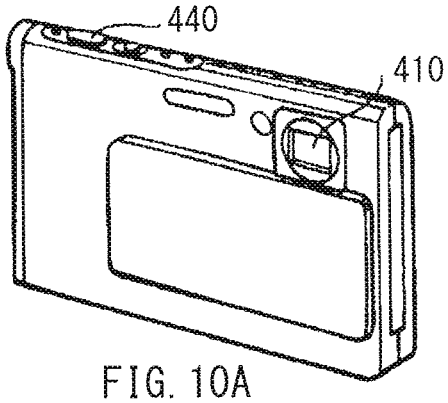
FIG. 10A is a perspective diagram illustrating appearance of application example 2 as viewed from its front side.
Figure 10B:
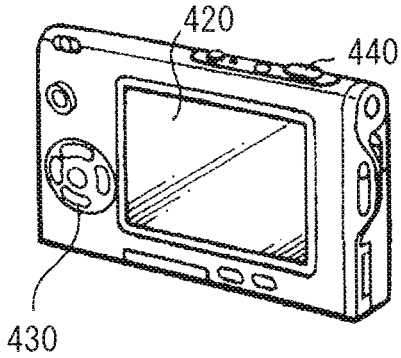
FIG. 10B is a perspective diagram illustrating appearance of the application example 2 as viewed from its back side.

FIGS. 10A and 10B each show appearance of a digital camera to which the display unit 1 of the above-described embodiment, etc. is applied. The digital camera may have, for example, a light emitting section 410 for flash, a display section 420, a menu switch 430, and a shutter button 440. The display section 420 is configured of the display unit 1 according to the above-described embodiment, etc.

Application Example 3

Figure 11:
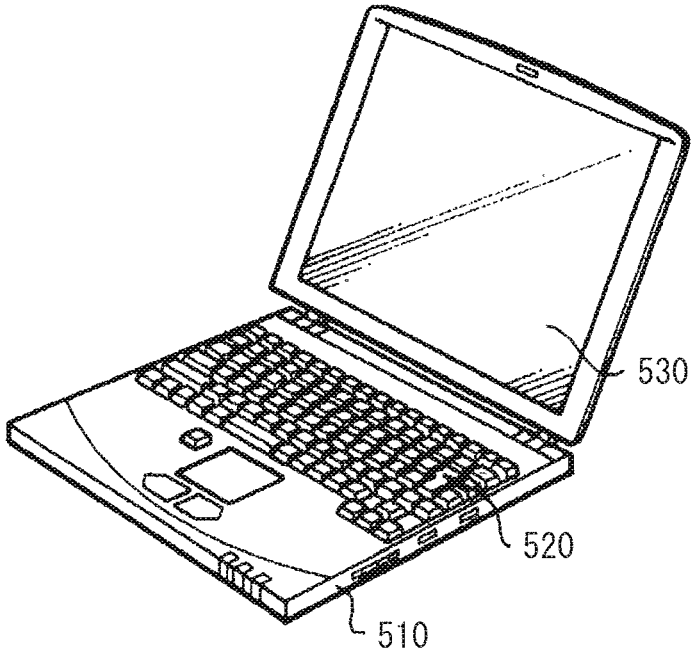
FIG. 11 is a perspective diagram illustrating appearance of application example 3 as viewed from its back side.

FIG. 11 illustrates appearance of a notebook personal computer to which the display unit 1 of the above-described embodiment, etc. is applied. The notebook personal computer may have, for example, a main body 510, a keyboard 520 for input operation of characters and the like, and a display section 530 that displays images. The display section 530 may be configured of the display unit 1 according to the above-described embodiment, etc.

Application Example 4

Figure 12:
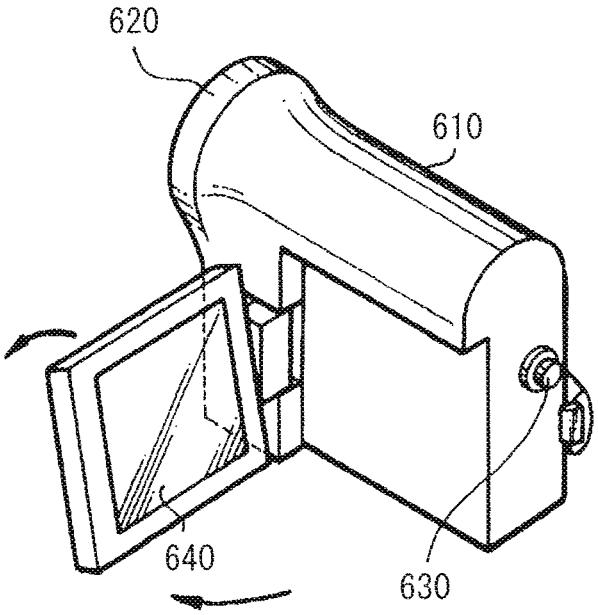
FIG. 12 is a perspective diagram illustrating appearance of application example 4.

FIG. 12 illustrates appearance of a video camcorder to which the display unit 1 of the above-described embodiment, etc. is applied. The video camcorder may have, for example, a main body section 610, an object-shooting lens 620 provided on a front side face of the main body section 610, a start/stop switch 630 for shooting, and a display section 640. The display section 640 is configured of the display unit 1 according to the above-described embodiment, etc.

Application Example 5

Figure 13A:
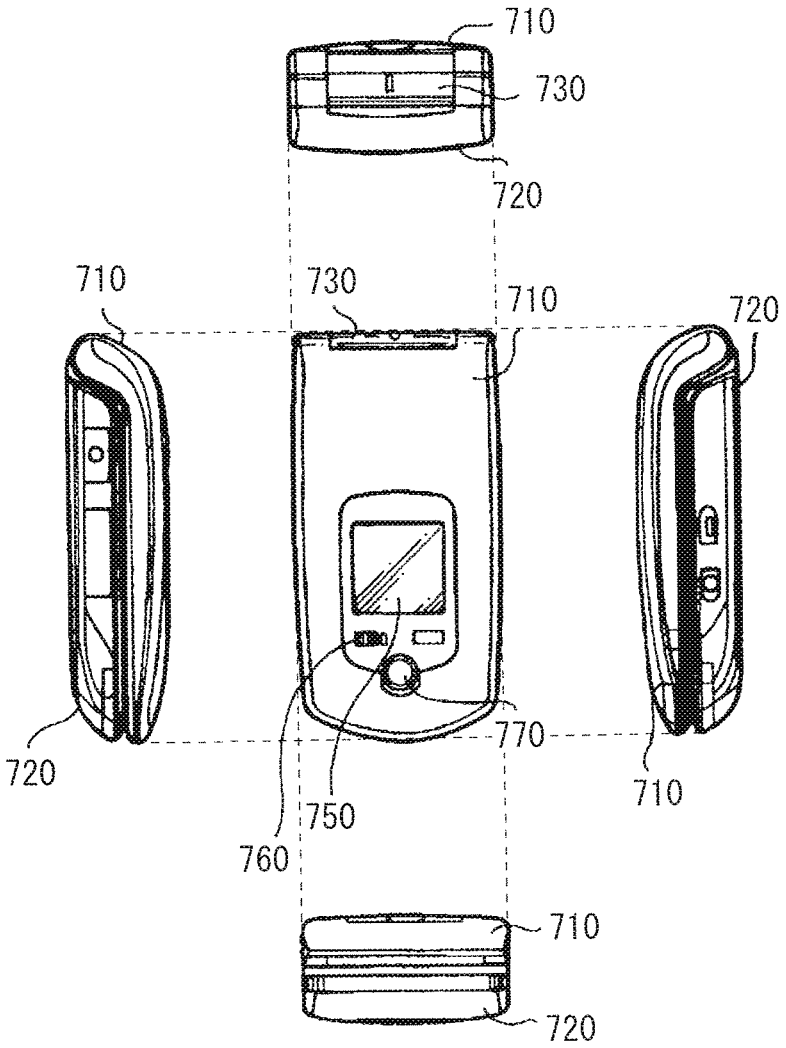
FIG. 13A includes a front view of application example 5 in a closed state, a left side view thereof, a right side view thereof, a top view thereof, and a bottom view thereof.
Figure 13B:
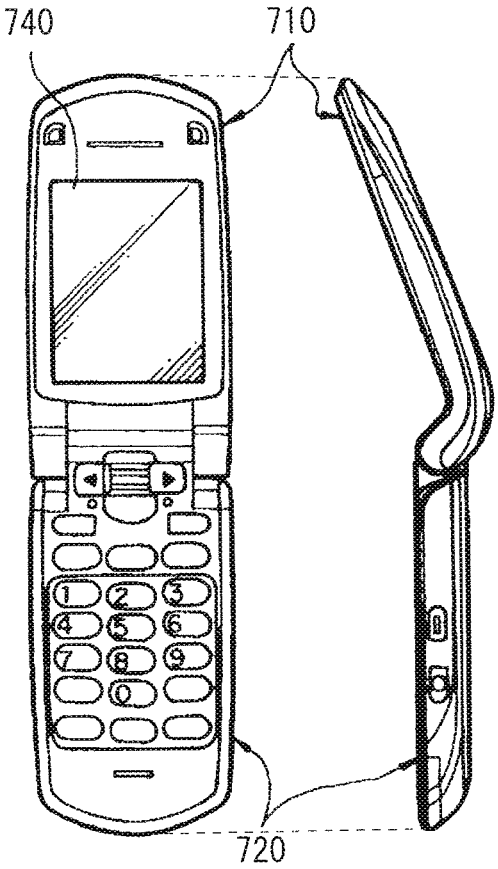
FIG. 13B includes a front view of the application example 5 in an opened state and a side view thereof.

FIGS. 13A and 13B each illustrate appearance of a mobile phone to which the display unit 1 of the above-described embodiment, etc. is applied. For example, the mobile phone may be configured of an upper housing 710 and a lower housing 720 connected to each other by a hinge section 730, and may have a display 740, a sub display 750, a picture light 760, and a camera 770. The display 740 or the sub display 750 may be configured of the display unit 1 according to the above-described embodiment, etc.

Although the present technology has been described with the example embodiment and the application examples thereof hereinbefore, the technology is not limited to the above-described embodiment, etc., and various modifications or alterations may be made.

For example, in the above-described embodiment, etc., the configuration of the pixel circuit 12 for active matrix drive is not limited to that described in the above-described embodiment, and a capacitor and/or a transistor may be added to the pixel circuit as necessary. In such a case, in accordance with the modification of the pixel circuit 12, a necessary drive circuit may be added in addition to the signal line drive circuit 23, the scan line drive circuit 24, the power supply circuit 25, the control line drive circuit 26, and the like. Furthermore, for example, the drive circuit 20 may be designed such that part of the operation described in the above-described embodiment is replaced with the operation described in JP-A-2010-160188.

Furthermore, although the timing generation circuit 21 and the image signal processing circuit 22 have controlled drive of each of the signal line drive circuit 23, the scan line drive circuit 24, the power supply circuit 25, and the control line drive circuit 26 in the above-described embodiment, etc., other circuits may control drive of such circuits. Furthermore, the signal line drive circuit 23, the scan line drive circuit 24, the power supply circuit 25, and the control line drive circuit 26 may each be controlled by hardware (a circuit) or software (a program).

Furthermore, the above-described embodiment, etc. has been described assuming that the source and the drain of each of the write transistor Tr2, the drive transistor Tr1, and the cutoff transistor Tr3 are fixed. However, it will be appreciated that a facing relationship between the source and the drain may be opposite to that in the above description depending on a direction of current flow. In such a case, source may be read as drain, and drain may be read as source in the above-described embodiment, etc.

Furthermore, the above-described embodiment, etc. has been described assuming that the write transistor Tr2, the drive transistor Tr1, and the cutoff transistor Tr3 are each formed of an n-channel MOS TFT. However, one or more of such transistors may be formed of a p-channel MOS TFT. When the drive transistor Tr1 is formed of the p-channel MOS TFT, the anode of the organic EL element 13 is changed to the cathode thereof, and the cathode of the organic EL element 13 is changed to the anode thereof in the above-described embodiment, etc. Furthermore, in the above-described embodiment, etc., the write transistor Tr2, the drive transistor Tr1, and the cutoff transistor Tr3 may each not necessarily be an amorphous silicon TFT or a micro-silicon TFT, and, for example, may be a low-temperature polysilicon TFT or an oxide semiconductor TFT.

It is possible to achieve at least the following configurations from the above-described example embodiments and the modifications of the disclosure.

(1) A display unit including: a display panel; and a drive circuit configured to drive the display panel, the display panel including a plurality of pixels arranged in a matrix, each pixel including a light emitting element and a pixel circuit, a plurality of signal lines, a plurality of scan lines, one or a plurality of first power lines, a plurality of second power lines, and a plurality of control lines, wherein the pixel circuit includes a first transistor having a gate electrically connected to one of the scan lines and a source or a drain electrically connected to one of the signal lines, and being configured to sample a voltage applied to the signal line, a second transistor having a source or a drain electrically connected to one of the first power lines, and being configured to control a current applied to the light emitting element in accordance with a level of the voltage sampled by the first transistor, a third transistor having a gate, a source, and a drain, the gate of the third transistor being electrically connected to one of the control lines, one of the source and the drain of the third transistor being electrically connected to a terminal of one of the source and the drain of the second transistor, the other of the source and the drain of the third transistor being electrically connected to one of the second power lines, the terminal being unconnected to the one or one of the plurality of first power lines, and a holding capacitor configured to hold the voltage sampled by the first transistor, and wherein the drive circuit includes a signal line drive circuit configured to continuously output a first fixed voltage to each of the signal lines in a first half of one frame period, and then continuously output a signal voltage corresponding to an image signal to each of the signal lines in a second half of the one frame period, a scan line drive circuit configured to, when the plurality of scan lines are grouped into a plurality of first units, sequentially output a first selection pulse for each of the first units to perform correction of adjusting a gate-to-source voltage of the second transistor to be close to a threshold voltage of the second transistor in a first half of one frame period, and then sequentially output a second selection pulse to each of the scan lines to write the signal voltage to the gate of the second transistor in a second half of the one frame period, a control line drive circuit configured to, when the plurality of control lines are grouped into a plurality of second units having a number equal to that of the first units, sequentially output a control pulse for each of the second units to write a second fixed voltage to the terminal before performing the correction, and a power supply circuit configured to continuously output a third fixed voltage and continuously output the second fixed voltage to each of the second power lines in one frame period.

(2) The display unit according to (1), wherein the second fixed voltage has a voltage value equal to or lower than a value of (the first fixed voltage minus the threshold voltage of the second transistor), and the third fixed voltage has a voltage value equal to or higher than a value of (a threshold voltage of the light emitting element plus a cathode voltage of the light emitting element).

(3) The display unit according to (1) or (2), wherein the scan line drive circuit simultaneously outputs the first selection pulse to all the scan lines in the first unit to perform the correction, and the control line drive circuit simultaneously outputs the control pulse to all the scan lines in the second unit to write the second fixed voltage to the terminal.

(4) The display unit according to any one of (1) to (3), wherein the scan line drive circuit is configured of a first gate driver capable of sequentially outputting the first selection pulse for each of the first units, and a second gate driver capable of sequentially outputting the second selection pulse to each of the scan lines.

(5) An electronic apparatus including a display unit, the display unit including a display panel, and a drive circuit configured to drive the display panel, the display panel including a plurality of pixels arranged in a matrix, each pixel including a light emitting element and a pixel circuit, a plurality of signal lines, a plurality of scan lines, one or a plurality of first power lines, a plurality of second power lines, and a plurality of control lines, wherein the pixel circuit includes a first transistor having a gate electrically connected to one of the scan lines and a source or a drain electrically connected to one of the signal lines, and being configured to sample a voltage applied to the signal line, a second transistor having a source or a drain electrically connected to one of the first power lines, and being configured to control a current applied to the light emitting element in accordance with a level of the voltage sampled by the first transistor, a third transistor having a gate, a source, and a drain, the gate of the third transistor being electrically connected to one of the control lines, one of the source and the drain of the third transistor being electrically connected to a terminal of one of the source and the drain of the second transistor, the other of the source and the drain of the third transistor being electrically connected to one of the second power lines, the terminal being unconnected to the one or one of the plurality of first power lines, and a holding capacitor configured to hold the voltage sampled by the first transistor, and wherein the drive circuit includes a signal line drive circuit configured to continuously output a first fixed voltage to each of the signal lines in a first half of one frame period, and then continuously output a signal voltage corresponding to an image signal to each of the signal lines in a second half of the one frame period, a scan line drive circuit configured to, when the plurality of scan lines are grouped into a plurality of first units, sequentially output a first selection pulse for each of the first units to perform correction of adjusting a gate-to-source voltage of the second transistor to be close to a threshold voltage of the second transistor in a first half of one frame period, and then sequentially output a second selection pulse to each of the scan lines to write the signal voltage to the gate of the second transistor in a second half of the one frame period, a control line drive circuit configured to, when the plurality of control lines are grouped into a plurality of second units having a number equal to that of the first units, sequentially output a control pulse for each of the second units to write a second fixed voltage to the terminal before performing the correction, and a power supply circuit configured to continuously output a third fixed voltage and continuously output the second fixed voltage to each of the second power lines in one frame period.

It should be understood by those skilled in the art that various modifications, combinations, sub-combinations and alterations may occur depending on design requirements and other factors insofar as they are within the scope of the appended claims or the equivalents thereof.

What is claimed is:

1. A display unit comprising: a display panel; and a drive circuit configured to drive the display panel, the display panel including a plurality of pixels arranged in a matrix, each pixel including a light emitting element and a pixel circuit, a plurality of signal lines, a plurality of scan lines, one or a plurality of first power lines, a plurality of second power lines, and a plurality of control lines, wherein the pixel circuit includes a first transistor having a gate electrically connected to one of the scan lines and a source or a drain electrically connected to one of the signal lines, and being configured to sample a voltage applied to the signal line, a second transistor having a source or a drain electrically connected to one of the first power lines, and being configured to control a current applied to the light emitting element in accordance with a level of the voltage sampled by the first transistor, a third transistor having a gate, a source, and a drain, the gate of the third transistor being electrically connected to one of the control lines, one of the source and the drain of the third transistor being electrically connected to a terminal of one of the source and the drain of the second transistor, the other of the source and the drain of the third transistor being electrically connected to one of the second power lines, the terminal being unconnected to the one or one of the plurality of first power lines, and a holding capacitor configured to hold the voltage sampled by the first transistor, and wherein the drive circuit includes a signal line drive circuit configured to continuously output a first fixed voltage to each of the signal lines throughout a first half of one frame period, and then continuously output a signal voltage corresponding to an image signal to each of the signal lines in a second half of the one frame period, a scan line drive circuit configured to, when the plurality of scan lines are grouped into a plurality of first units, sequentially output a first selection pulse for each of the first units to perform correction of adjusting a gate-to-source voltage of the second transistor to be close to a threshold voltage of the second transistor in a first half of one frame period, and then sequentially output a second selection pulse to each of the scan lines to write the signal voltage to the gate of the second transistor in a second half of the one frame period, a control line drive circuit configured to, when the plurality of control lines are grouped into a plurality of second units having a number equal to that of the first units, sequentially output a control pulse for each of the second units to write a second fixed voltage to the terminal before performing the correction, and a power supply circuit configured to continuously output a third fixed voltage and continuously output the second fixed voltage to each of the second power lines in one frame period.

2. The display unit according to claim 1, wherein the second fixed voltage has a voltage value equal to or lower than a value of (the first fixed voltage minus the threshold voltage of the second transistor), and the third fixed voltage has a voltage value equal to or higher than a value of (a threshold voltage of the light emitting element plus a cathode voltage of the light emitting element).

3. The display unit according to claim 2, wherein the scan line drive circuit simultaneously outputs the first selection pulse to all the scan lines in the first unit to perform the correction, and the control line drive circuit simultaneously outputs the control pulse to all the scan lines in the second unit to write the second fixed voltage to the terminal.

4. The display unit according to claim 2, wherein the scan line drive circuit is configured of a first gate driver capable of sequentially outputting the first selection pulse for each of the first units, and a second gate driver capable of sequentially outputting the second selection pulse to each of the scan lines.

5. An electronic apparatus comprising a display unit, the display unit including a display panel, and a drive circuit configured to drive the display panel, the display panel including a plurality of pixels arranged in a matrix, each pixel including a light emitting element and a pixel circuit, a plurality of signal lines, a plurality of scan lines, one or a plurality of first power lines, a plurality of second power lines, and a plurality of control lines, wherein the pixel circuit includes a first transistor having a gate electrically connected to one of the scan lines and a source or a drain electrically connected to one of the signal lines, and being configured to sample a voltage applied to the signal line, a second transistor having a source or a drain electrically connected to one of the first power lines, and being configured to control a current applied to the light emitting element in accordance with a level of the voltage sampled by the first transistor, a third transistor having a gate, a source, and a drain, the gate of the third transistor being electrically connected to one of the control lines, one of the source and the drain of the third transistor being electrically connected to a terminal of one of the source and the drain of the second transistor, the other of the source and the drain of the third transistor being electrically connected to one of the second power lines, the terminal being unconnected to the one or one of the plurality of first power lines, and a holding capacitor configured to hold the voltage sampled by the first transistor, and wherein the drive circuit includes a signal line drive circuit configured to continuously output a first fixed voltage to each of the signal lines throughout a first half of one frame period, and then continuously output a signal voltage corresponding to an image signal to each of the signal lines in a second half of the one frame period, a scan line drive circuit configured to, when the plurality of scan lines are grouped into a plurality of first units, sequentially output a first selection pulse for each of the first units to perform correction of adjusting a gate-to-source voltage of the second transistor to be close to a threshold voltage of the second transistor in a first half of one frame period, and then sequentially output a second selection pulse to each of the scan lines to write the signal voltage to the gate of the second transistor in a second half of the one frame period, a control line drive circuit configured to, when the plurality of control lines are grouped into a plurality of second units having a number equal to that of the first units, sequentially output a control pulse for each of the second units to write a second fixed voltage to the terminal before performing the correction, and a power supply circuit configured to continuously output a third fixed voltage and continuously output the second fixed voltage to each of the second power lines in one frame period.

6. The electronic apparatus according to claim 5, wherein the second fixed voltage has a voltage value equal to or lower than a value of (the first fixed voltage minus the threshold voltage of the second transistor), and the third fixed voltage has a voltage value equal to or higher than a value of (a threshold voltage of the light emitting element plus a cathode voltage of the light emitting element).

7. The electronic apparatus according to claim 6, wherein the scan line drive circuit simultaneously outputs the first selection pulse to all the scan lines in the first unit to perform the correction, and the control line drive circuit simultaneously outputs the control pulse to all the scan lines in the second unit to write the second fixed voltage to the terminal.

8. The electronic apparatus according to claim 6, wherein the scan line drive circuit is configured of a first gate driver capable of sequentially outputting the first selection pulse for each of the first units, and a second gate driver capable of sequentially outputting the second selection pulse to each of the scan lines.

* * * * *